US008640616B2

(12) United States Patent
Funahata

(10) Patent No.: US 8,640,616 B2
(45) Date of Patent: Feb. 4, 2014

(54) PRINTING APPARATUS AND PRINTING METHOD

(75) Inventor: Katsuyuki Funahata, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 420 days.

(21) Appl. No.: 13/020,916

(22) Filed: Feb. 4, 2011

(65) Prior Publication Data

US 2011/0185932 A1 Aug. 4, 2011

(30) Foreign Application Priority Data

Feb. 4, 2010 (JP) ..... 2010-022656

(51) Int. Cl.
*B41F 35/00* (2006.01)

(52) U.S. Cl.
USPC ..... 101/423; 101/425

(58) Field of Classification Search
USPC ..... 101/423
See application file for complete search history.

(56) References Cited

U.S. PATENT DOCUMENTS

| | | | | |
|---|---|---|---|---|
| 6,432,211 | B1 | 8/2002 | Schmitt et al. | |
| 7,441,502 | B2 * | 10/2008 | Oh | 101/425 |
| 7,765,929 | B2 * | 8/2010 | Kim et al. | 101/483 |
| 7,987,782 | B2 * | 8/2011 | Kim et al. | 101/217 |
| 8,365,663 | B2 * | 2/2013 | Kim et al. | 101/492 |
| 2007/0009835 | A1 * | 1/2007 | Yoo et al. | 430/311 |
| 2007/0051257 | A1 * | 3/2007 | Heo et al. | 101/170 |
| 2007/0153043 | A1 | 7/2007 | Oh | |
| 2008/0252841 | A1 | 10/2008 | Funahata et al. | |

FOREIGN PATENT DOCUMENTS

| | | |
|---|---|---|
| JP | 11-011037 | 1/1999 |
| JP | 11-058921 | 3/1999 |
| JP | 2006-124546 | 5/2006 |
| JP | 2006-281483 | 10/2006 |
| JP | 2007-183549 | 7/2007 |
| JP | 2008-261989 | 10/2008 |
| JP | 2010-254917 | 11/2010 |

OTHER PUBLICATIONS

JP Office Action of 2010-022656 dated Feb. 21, 2012 with partial English translation.

* cited by examiner

*Primary Examiner* — Anthony Nguyen
(74) *Attorney, Agent, or Firm* — Antonelli, Terry, Stout & Kraus, LLP.

(57) ABSTRACT

The present invention provides a printing apparatus and a printing method capable of washing a printing plate with a high degree of cleanliness. The present invention is a printing apparatus and a printing method, wherein: the printing apparatus comprises a print roll, a coater that is placed below the print roll and forms ink on the print roll, a first base placed above the print roll, a first stage placed on the bottom face of the first base, a first printing plate placed on the bottom face of the first stage, a print object to which the ink formed on the print roll is transcribed, a first stage placed on the top or bottom face of the print object, and a washer for washing the first printing plate; the washer has a washing device; and a spray nozzle of the washing device is directed to the side where the first base exists.

19 Claims, 17 Drawing Sheets

PRINTING APPARATUS AND PRINTING METHOD

CLAIM OF PRIORITY

The present application claims priority from Japanese patent application serial No. 2010-022656 filed on Feb. 4, 2010, the content of which is hereby incorporated by reference into this application.

BACKGROUND OF THE INVENTION

1. Field of the Invention

The present invention relates to a printing apparatus and a printing method.

2. Description of the Related Arts

As conventional technologies related to the present invention, the following technologies are disclosed in JP-A No. 183549/2007 and JP-A No. 58921/1999(H11). JP-A No. 183549/2007 describes a printing apparatus comprising: a stage where a plurality of printing plates scribed into patterns to be formed and a substrate for forming the patterns are located; a plurality of printing nozzles for applying pattern materials respectively; a plurality of print rolls the peripheries of which are coated with the pattern materials by using the printing nozzles, partially transcribing the pattern materials to protrusions of the printing plates via the printing plates located on the stage and thereafter transcribing remaining pattern materials to the substrate; and a washer placed movably for washing the printing plates. JP-A No. 58921/1999 (H11) describes a technology comprising the processes of: forming a coated face by coating a silicone rubber face with a resin; pressing a relief printing plate formed into a predetermined shape onto the coated face, transcribing the resin to the protrusions of the relief printing plate, and removing the resin; and transcribing the resin remaining on the coated face to a substrate.

A problem of a conventional printing apparatus has been that, since a printing plate is washed by spraying a cleaning agent from above the printing plate, ink gets in the recesses of the printing plate and the board is hardly washed with a high degree of cleanliness.

An object of the present invention is to provide a printing apparatus and a printing method capable of washing a printing plate with a high degree of cleanliness.

SUMMARY OF THE INVENTION

In order to solve the above problem, a feature of the present invention is, for example, a printing apparatus wherein: the printing apparatus comprises a print roll, a coater placed below the print roll for forming ink on the print roll, a first base placed above the print roll, a first stage and a second stage placed on the bottom face of the first base, a first printing plate placed on the bottom face of the first stage, a print object placed on the bottom face of the second stage to which the ink formed on the print roll is transcribed, and a washer for washing the first printing plate; the washer has a washing device; and a spray nozzle of the washing device is directed to the side where the first base exists.

Further, another feature of the present invention is a printing method comprising the processes of: moving a slit of a coater upward and bringing it into contact with a print roll; moving the slit and forming an ink-filled film on the surface of the print roll; bringing the ink-filled film into contact with a printing plate and forming an ink pattern on the surface of the printing plate; washing a printing plate placed above a washing device with the washing device; and transcribing the ink pattern to a print object.

The present invention makes it possible to provide a printing apparatus and a printing method capable of washing a printing plate with a high degree of cleanliness. Meanwhile, other problems, construction, and effects than described above are clarified from the explanations on embodiments below.

DETAILED DESCRIPTION OF THE PREFERRED EMBODIMENTS

Embodiments according to the present invention are hereunder explained in detail in reference to drawings.

The present invention takes into consideration the drawback of a conventional printing apparatus having a printing plate placed so that the print face may be directed upward and a washer for spraying a cleaning agent from above the printing plate and washing the printing plate, wherein ink gets in the recesses of the printing plate and hence the printing plate cannot be washed for a short period of time or with a high degree of cleanliness. In view of the drawback, a printing plate is placed so that the print face may be directed downward and a washer for spraying a cleaning agent from below the printing plate and washing the printing plate is placed.

More specifically, the present invention is a printing apparatus characterized in that, in a reverse printing apparatus comprising a print roll having a silicone rubber blanket on the surface, a coater for forming a filled film acting as a pattern material on the surface of the print roll, an anastatic printing plate for forming an intended pattern on the surface of the print roll by bringing it into contact with the filled film acting as the pattern material formed on the surface of the print roll and removing unnecessary parts, and a print object to which the pattern formed on the surface of the print roll is transcribed, not only the anastatic printing plate is placed above the print roll so that the print face may be directed downward but also the anastatic printing plate is placed on both the sides of the print object, a washer having a washing device and a dryer is placed below the anastatic printing plate, and a spray nozzle of the washer is directed upward.

The contents of the present applied invention are explained further in detail by showing concrete embodiments hereunder. The following embodiments show concrete examples of the contents of the present applied invention, but the present applied invention is not limited to the embodiments and can be variously changed and modified by a person skilled in the art within the range of technological thought disclosed in the present specification.

Embodiment 1

Figure 1A:
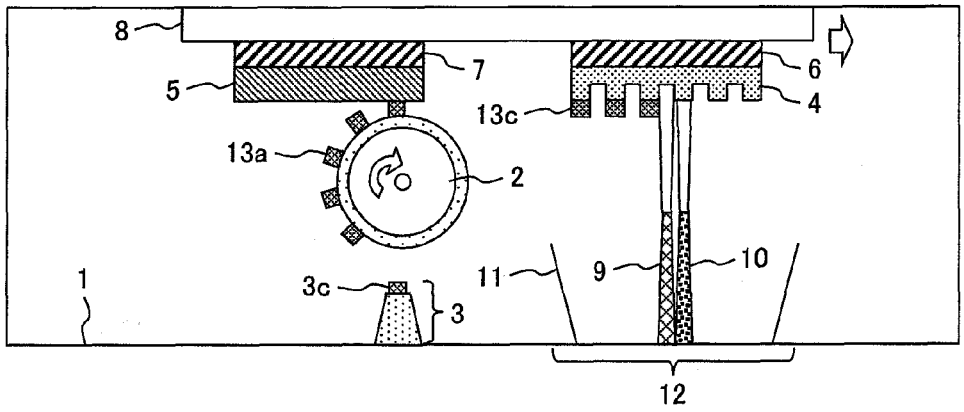
FIG. 1A is a sectional view schematically showing printing apparatuses according to embodiment 1 of the present invention.
Figure 1B:
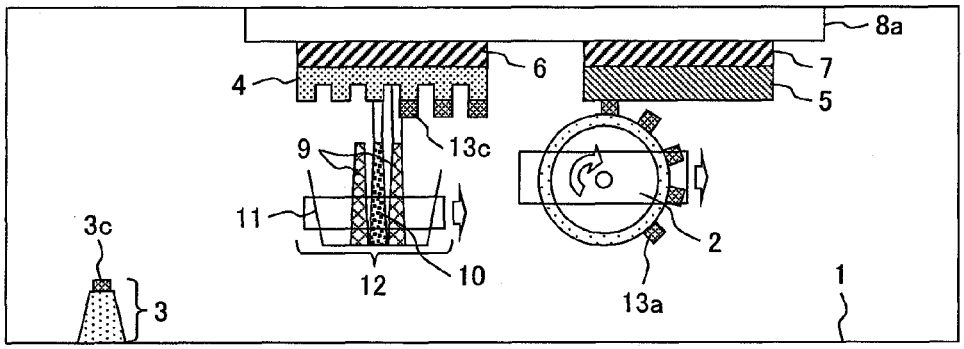
FIG. 1B is a sectional view schematically showing printing apparatuses according to embodiment 2 of the present invention.
Figure 1C:
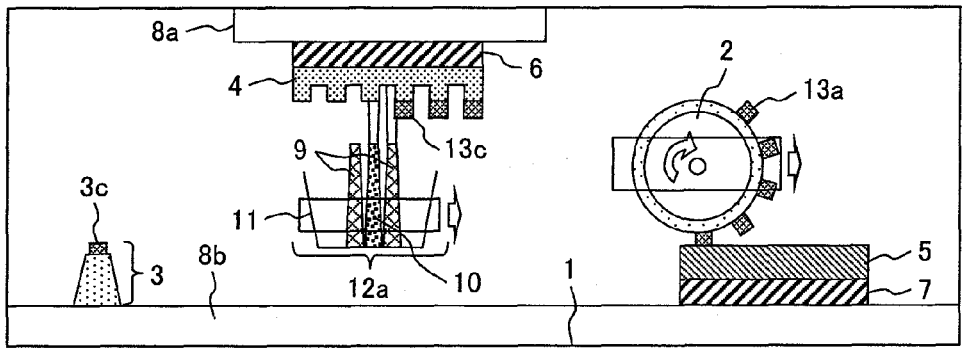
FIG. 1C is a sectional view schematically showing printing apparatuses according to embodiment 3 of the present invention.

FIGS. 1A to 1C are sectional views schematically showing printing apparatuses using a reverse printing method according to the present embodiments. The printing apparatus in FIG. 1A comprises a frame 1, a print roll 2, a coater 3, a printing plate 4, a print object 5, a stage 6, a stage 7, a movable base 8, a washing device 9, a dryer 10, a cleaning agent recovery device 11, and a washer 12. Here, the frame 1 is not essential for the printing apparatus.

In FIG. 1A, the movable base 8 is placed at the upper part of the frame 1 and the stage 6 and the stage 7 are tightly placed on the bottom face of the movable base 8. In other words, the movable base 8 is placed above the print roll 2 and the stage 6 and the stage 7 are placed on the bottom face of the movable base 8. The printing plate 4 and the print object 5 are placed on the bottom faces of the stage 6 and the stage 7 in a sticking manner. In other words, the stage 7 is placed on the top face of the print object 5. The stage 6 is referred to as a first stage and the stage 7 is referred to as a second stage. Ink formed on the print roll 2 is transcribed to the print object 5. The print roll 2 and the coater 3 are tightly placed below the frame 1. In other words, the coater 3 is placed below the print roll 2. The washer 12 is tightly placed at the lower part of the frame 1 on the side of the rotation direction of the print roll 2. The washer 12 comprises the washing device 9, the dryer 10, and the cleaning agent recovery device 11. The printing apparatus in FIG. 1A is a type of moving the printing plate 4 and the print object 5. A spray nozzle of the washing device 9 and a spray nozzle of the dryer 10 are directed to the side where the movable base 8 exists.

Here, although the washing device is tightly placed in FIG. 1A, the present invention is not limited to this case and a movable washer may also be placed.

Further, although a pattern is formed by using a half of the circumferential length of the print roll in FIG. 1A, the present invention is not limited to the case and the whole circumferential length of the print roll may also be used.

As shown in FIG. 1A, the printing plate 4 is placed above the print roll 2 and the print face of the printing plate 4 is directed downward. The washer 12 for washing and drying the printing plate 4 is placed below the printing plate 4. By so doing, it is possible: not only to adopt a jet washing method known as a simple liquid washing method and wash the printing plate with a high degree of cleanliness; but also to cope with the formation of a minute pattern 10 microns or less in pattern width and form a pattern of a high fineness, a high reproducibility, and a high operation rate.

In particular, since a pattern is formed while the printing plate and the print object aligned on the movable base travel a short distance in the horizontal direction above the print roll tightly placed, it is possible to form a pattern of a high dimensional accuracy and obtain a printing apparatus of a low cost.

Further, in forming a pattern, since a pattern is formed by using a half of the circumferential length of the print roll, it is possible to prolong the lifespan of a blanket being mounted on the surface of the print roll and having silicone rubber on the outermost surface. Furthermore, since the diameter of the print roll is increased, the area where the print roll touches the printing plate also increases, thereby the deformation of the blanket caused by compression stress reduces, and hence it is possible to reduce the depth of the recesses of the printing plate. Moreover, the whole circumferential length of the print roll may be used, it is possible to cope with the formation of a minute pattern 10 microns or less in pattern width, and it is possible to form a pattern of a high fineness, a high reproducibility, and a high operation rate. In addition, since the movable section comprises only two units of the base and the print roll and the travel distance of the base is short, it is possible to form a pattern of a high fineness, a high reproducibility, and a high operation rate.

In addition, the cleaning agent recovery device not only recovers a cleaning agent but also plays the role of preventing the cleaning agent from scattering to the print roll and the print object and hence it is possible to steadily form a pattern of a high fineness, a high reproducibility, and a high operation rate.

FIGS. 2A to 2D are sectional views schematically showing the processes of a printing method shown in FIG. 1A.

Figure 2A:
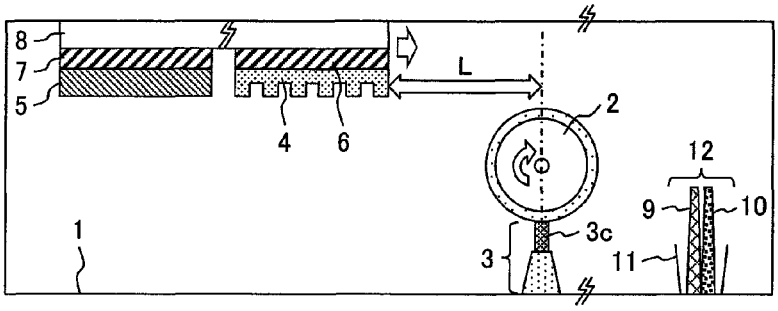
FIGS. 2A to 2D are sectional views schematically showing a printing apparatus according to the embodiment 1 of the present invention.

Firstly, a process of forming a pattern while moving the printing plate 4 and the print object 5 placed on the movable base 8 toward the right relative to the print roll 2 is explained. The process of forming an ink-filled film 13 on the surface of the print roll 2 shown in FIG. 2A is as follows. A slit 3*c* of the coater 3 placed below the print roll 2 on which a silicone rubber blanket is mounted moves upward and touches the print roll 2. Thereafter, the slit 3*c* moves downward so that the space between the surface of the print roll 2 and the slit 3*c* may have a predetermined value, the print roll 2 rotates at a predetermined rotation frequency in a fixed state, and thereby an ink-filled film of a desired thickness is formed.

Here, in the process of forming the ink-filled film 13 on the surface of the print roll 2, the distance L between the printing plate 4 placed on the movable base 8 and the center of the slit 3*c* is equal to a half of the circumferential length of the print roll 2. Further, the length of the printing plate 4 and the length of the print object 5 are also equal to a half of the circumferential length of the print roll 2.

Further, the rotation speed of the print roll 2 is identical to the travel speed of the movable base 8 on which the printing plate 4 and the print object 5 are placed and the start of the rotation synchronizes with the start of the travel. Furthermore, the distance between the rear end of the printing plate 4 and the front end of the print object 5 is equal to a half of the circumferential length of the print roll 2.

Figure 2B:
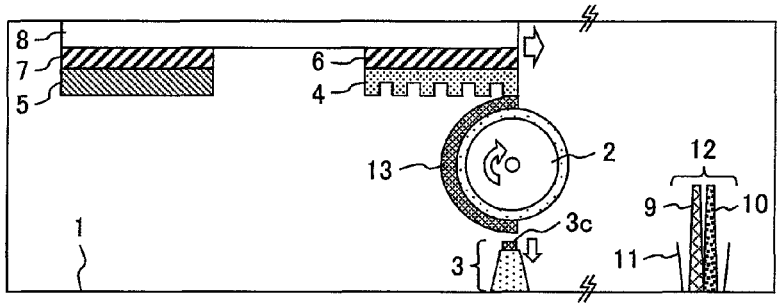

Successively, the process of forming an ink pattern 13*a* on the surface of the print roll 2 shown in FIG. 2B is as follows. The ink-filled film 13 touches the printing plate 4 when the front end of the ink-filled film 13 formed on the surface of the print roll 2 reaches above the center of the slit 3*c* of the coater 3. The ink at the part touching the protrusions of the printing plate 4 is removed from the ink-filled film 13 formed on the surface of the print roll 2 and an ink pattern 13*a* is formed on the surface of the print roll 2.

Here, the ink pattern 13*a* formed on the surface of the print roll 2 corresponds to the concave pattern formed on the printing plate 4. It is important to set the depth of the recesses of the printing plate 4 so that the ink-filled film may not touch the bottom face of the concave pattern formed on the printing plate 4 when the printing plate 4 touches the ink-filled film 13 formed on the surface of the print roll 2.

Figure 2C:
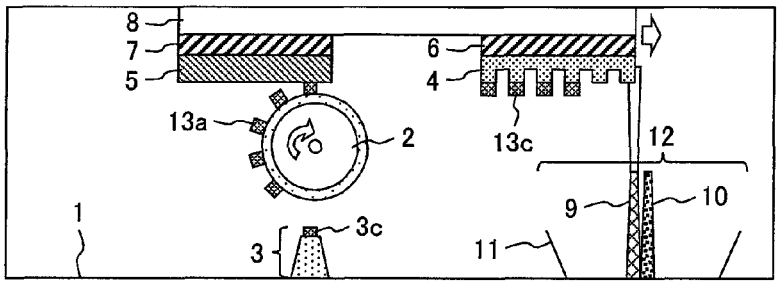

Successively, the process of transcribing the ink pattern 13*a* formed on the surface of the print roll 2 to the print object 5 and removing and washing the ink remaining on the printing plate 4 shown in FIG. 2C is as follows. Washing starts at the same time when the front end of the printing plate 4 reaches the position where the washing device 9 is placed. Then the ink pattern 13*a* is transcribed to the print object 5 at the same time when the front end of the print object 5 touches the head pattern of the ink pattern 13*a* formed on the print roll 2. Moreover, the transcription of the ink pattern 13*a* to the print object 5 is completed simultaneously with the completion of the removal and washing of the ink 13*c* remaining on the printing plate 4.

Figure 2D:
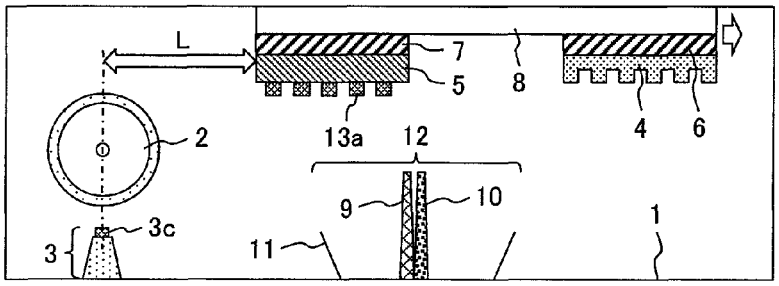

Successively, the process of carrying out the print object 5*a* to which the ink pattern is transcribed and carrying in a next print object 5 shown in FIG. 2D is as follows. The movable base 8 stops when the distance from the rear end of the printing plate 4 to the extension of the center line of the slit 3*c* of the coater 3 comes to be equal to a half of the circumferential length of the print roll. Then the print object 5 to which the ink pattern is transcribed is carried out, a next print object is carried in and set, and the pattern forming process finishes.

By repeating the above processes, it is possible to form a pattern of a high print reproducibility and a high operation rate at a low cost. Further, even in the case of using a printing plate 10 microns or less in pattern width that has been regarded as hardly washable with a liquid, it is possible to wash the printing plate with a high degree of cleanliness and form a stable pattern of a high print reproducibility.

Furthermore, a feature of the present embodiment is that, since patterns can be formed by using different halves of the periphery of a silicone rubber blanket mounted on the surface of a print roll, the lifespan of the silicone rubber blanket is long. Note that, although a pattern is formed by using a half of the circumferential length of a print roll, the present invention is not limited to this case and it is also possible to use the whole circumferential length of a print roll.

Figure 3:
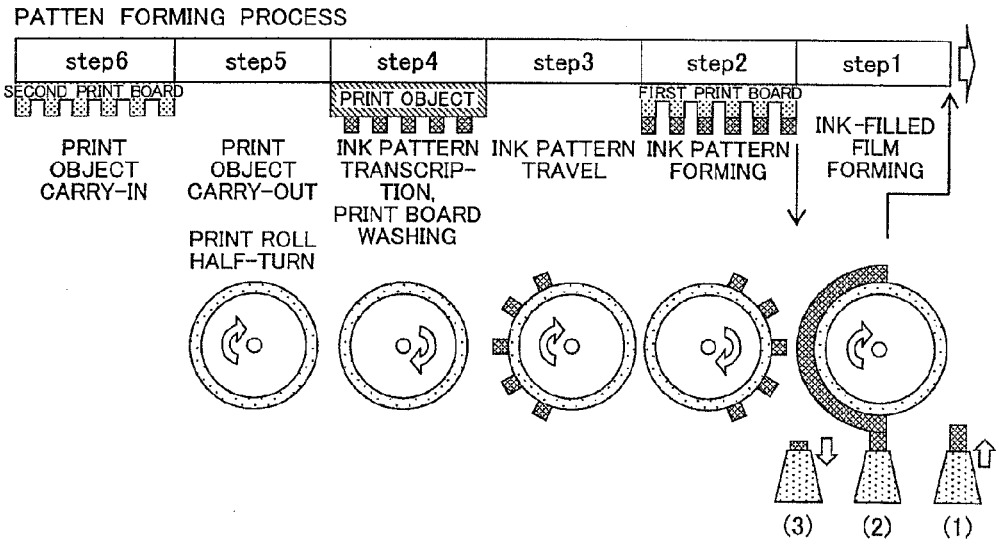
FIG. 3 is a sectional view schematically showing the processes of a printing method using a printing apparatus according to the embodiment 1 of the present invention.

FIG. 3 is a process chart schematically showing a pattern forming process using a printing apparatus and a reverse printing method according to the present embodiment. As shown in the figure, the pattern forming process comprises the six processes below.

1) To form an ink-filled film at the part of a half of the circumferential length on the surface of a print roll. At the same time, to move a movable base at which a printing plate and a print object are set only a distance corresponding to a half of the circumferential length of the print roll.

2) To form an ink pattern on the surface of the print roll by bringing the printing plate into contact with the ink-filled film formed at the part of the half of the circumferential length on the surface of the print roll and removing the ink of unnecessary parts from the ink-filled film.

3) To rotate the print roll only a distance corresponding to the half of the circumferential length and prepare for the transcription of the ink pattern to the print object.

4) To bring the ink pattern formed on the surface of the print roll into contact with the print object such as a glass substrate and transcribe the ink pattern to the print object. At the same time, to wash the ink remaining on the printing plate with a washer and dry the printing plate.

5) To carry out the print object on which the ink pattern is formed. At the same time, to rotate the print roll only a distance corresponding to the half of the circumferential length and prepare to form an ink-filled film on the unused surface of the print roll.

6) To carry in and set a next print object and prepare for backward pattern forming.

The following aspects are considered as the control of the devices such as the print roll, the coater, the movable base at which the printing plate and the print object are set, and the washer in the six processes. In the process 1), the rotation speed of the print roll and the travel speed of the movable base at which the printing plate and the print object are set are identical and the rotation and the travel start simultaneously. In the process 2), simultaneously with the commencement of the ink pattern forming, the slit of the coater descends downward and the ink-filled film stops to form. In the process 4), simultaneously with the commencement of the transcription of the ink pattern, the washer starts to wash the printing plate. By controlling the devices with a high degree of accuracy, it is possible not only to operate the printing apparatus continuously but also to form a pattern having the same quality as a photolithography process.

Embodiment 2

The printing apparatus in FIG. 1B comprises a frame 1, a print roll 2, a coater 3, a printing plate 4, a print object 5, a stage 6, a stage 7, a fixed base 8*a*, washing devices 9, a dryer 10, a cleaning agent recovery device 11, and a washer 12. Here, the frame 1 is not essential for the printing apparatus. In FIG. 1B, the fixed base 8*a* is placed at the upper part of the frame 1 and the stage 6 and the stage 7 are tightly placed on the bottom face of the fixed base 8*a*. The printing plate 4 and the print object 5 are placed on the bottom faces of the stage 6 and the stage 7 in a sticking manner. The print roll 2 and the washer 12 having movable function of traveling using the top face or the bottom face of the frame 1 as a guide are placed. The washer 12 comprises the two washing devices 9, the dryer 10, and the cleaning agent recovery device 11. The frame 1 and the coater 3 are tightly placed so that the front end of the printing plate 4 below the frame 1 may align with the center of the slit 3*c*. The printing apparatus in FIG. 1B is a type of moving the print roll 2 and the washer 12.

Here, although two washing devices 9 are placed in FIG. 1B, the present invention is not limited to this case and one washing device or plural washing devices may also be placed.

As shown in FIG. 1B, the printing plate 4 is placed above the print roll 2 so that the print face may be directed downward. Further, by placing the washer 12 for washing and drying the printing plate 4 below the printing plate 4, it is possible to adopt a jet washing method known as a simple liquid washing method. Furthermore, it is possible: not only to wash the printing plate with a high degree of cleanliness; but also to cope with the formation of a minute pattern 10 microns or less in pattern width and form the pattern of a high fineness, a high reproducibility, and a high operation rate.

In particular, since a pattern is formed by moving the print roll 2 and the washer 12, it is possible to wash the printing plate plural times and thus stably form a pattern of a high fineness with a high reproducibility.

Further, in forming a pattern, since a pattern is formed by using a half of the circumferential length of the print roll, it is possible to prolong the lifespan of a blanket being mounted on the surface of the print roll 2 and having silicone rubber on the outermost surface. Furthermore, since the area where the print roll touches the printing plate increases by increasing the diameter of the print roll and thereby the deformation of the blanket caused by compression stress reduces, it is possible to reduce the depth of the recesses of the printing plate.

In addition, the cleaning agent recovery device 11 not only recovers a cleaning agent but also plays the role of preventing the cleaning agent from scattering to the print roll and the print object and hence it is possible to steadily form a pattern of a high fineness, a high reproducibility, and a high operation rate.

Figure 4A:
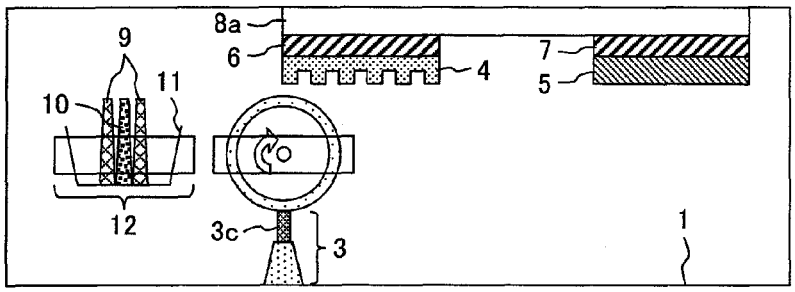
FIGS. 4A to 4D are sectional views schematically showing a printing apparatus according to the embodiment 2 of the present invention.

FIGS. 4A to 4D are sectional views schematically showing the processes of a printing method shown in FIG. 1B. The process of forming an ink-filled film on the surface of the print roll 2 shown in FIG. 4A is as follows. The slit 3*c* of the coater 3 placed below the print roll 2 on which a silicone rubber blanket is mounted touches the print roll 2 by moving upward.

Successively, an ink-filled film of a predetermined thickness is formed by rotating the print roll 2 at a rotation frequency that allows a film of a predetermined thickness to be formed in the state of moving downward and fixing the slit 3*c* so as to set the space between the surface of the print roll 2 and the slit 3*c* at a predetermined value.

Here, in the process of forming an ink-filled film 13 on the surface of the print roll 2, the printing plate 4 placed on the fixed base, the print roll 2, and the coater 3 are placed so that the front end of the printing plate 4, the center of the print roll 2, and the center of the slit 3*c* may nearly align with each other.

Further, the length of the printing plate 4, the length of the print object 5, and the distance from the rear end of the printing plate 4 to the front end of the print object 5 are equal to a half of the circumferential length of the print roll 2.

Figure 4B:
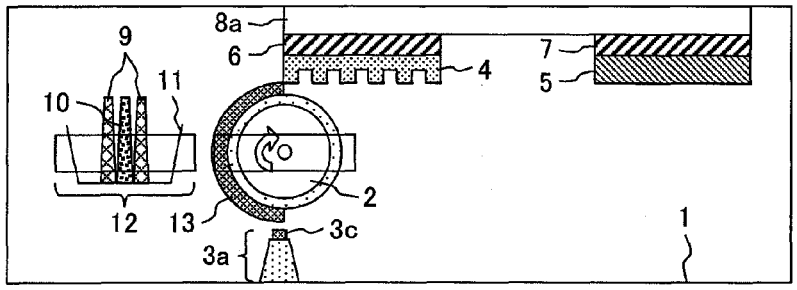

Successively, the process of forming an ink pattern 13*a* on the surface of the print roll 2 shown in FIG. 4B is as follows. The head of the ink-filled film 13 formed on the surface of the print roll 2 reaches the front end of the printing plate 4 and the ink-filled film 13 touches the printing plate 4. At the same time, the print roll 2 starts to move toward the print object 5, the ink at the part touching the protrusions of the printing plate 4 is removed from the ink-filled film 13 formed on the surface of the print roll 2, and an ink pattern 13*a* is formed on the surface of the print roll 2.

Simultaneously with the end of the formation of the ink pattern 13*a*, the washer 12 comprising the two washing devices 9, the dryer 10, and the cleaning agent recovery device 11 starts to move toward the printing plate 4 in order to wash the ink remaining on the printing plate 4.

Here, the ink pattern formed on the surface of the print roll 2 corresponds to the concave pattern part formed on the printing plate 4. It is important to set the depth of the recesses of the printing plate 4 so that the ink-filled film may not touch the bottom face of the concave pattern formed on the printing plate 4 when the printing plate 4 touches the ink-filled film 13 formed on the surface of the print roll 2.

Figure 4C:
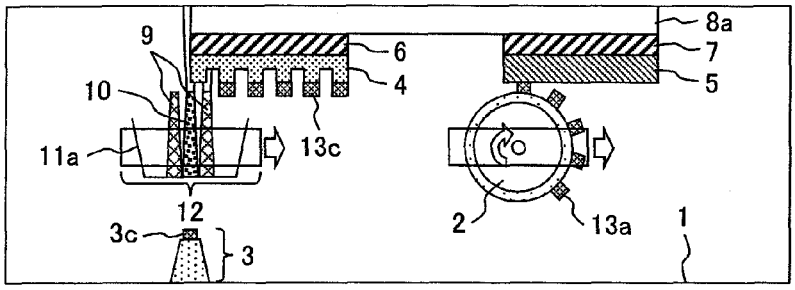

Successively, the process of transcribing the ink pattern 13*a* formed on the surface of the print roll 2 to the print object 5 and removing and washing the ink remaining on the printing plate 4 shown in FIG. 4C is as follows. The ink pattern 13*a* formed on the surface of the print roll 2 touches the print object 5 and the transcription starts. At the same time, the washer 12 that has moved to the front end of the printing plate 4 starts washing. The whole ink pattern 13*a* formed on the surface of the print roll 2 is transcribed to the print object 5 and thus the transcription of the ink pattern 13*a* is completed. At the same time, the removal and washing of the ink remaining on the printing plate 4 with the washer 12 are also completed.

Figure 4D:
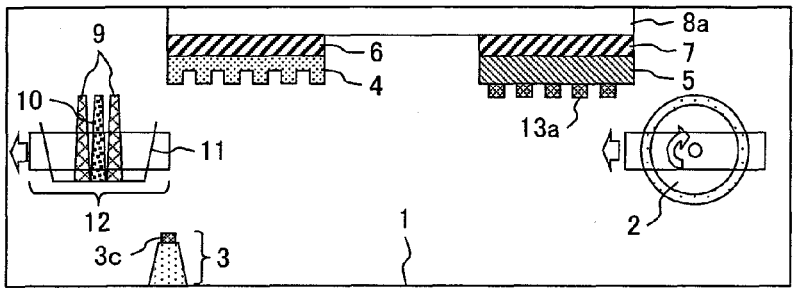

Successively, the process of carrying out the print object 5*a* to which the ink pattern is transcribed and carrying in a next print object 5 shown in FIG. 4D is as follows. The print roll 2 moves to a position where the center of the print roll 2 aligns with the front end of the printing plate 4 on the extension of the center line of the slit 3*c* of the coater 3 and stops. At the same time, the washer 12 moves to a predetermined standby position on the side of the coater 3 and stops. The print object 5*a* to which the ink pattern 13*a* is transcribed is carried out, a next print object is carried in and set, and the pattern forming process finishes.

By repeating the above processes, it is possible to form a pattern of a high print reproducibility and a high operation rate at a low cost. Further, one of the features of the present embodiment is that, even in the case of using a printing plate 10 microns or less in pattern width that has been regarded as hardly washable with a liquid, it is possible to wash the printing plate with a high degree of cleanliness and stably form a pattern of a high print reproducibility.

Further, another feature of the present embodiment is that, in forming a pattern, since a pattern is formed by using a half periphery of the silicone rubber blanket mounted on the surface of the print roll, the lifespan of the silicone rubber blanket is long.

Here, although two washing devices are placed in the present embodiment, one washing device or plural washing devices may be placed. Further, the same is applied to the dryer too and not only one dryer or plural dryers may be placed but also an identical printing plate may be washed twice.

Figure 5:
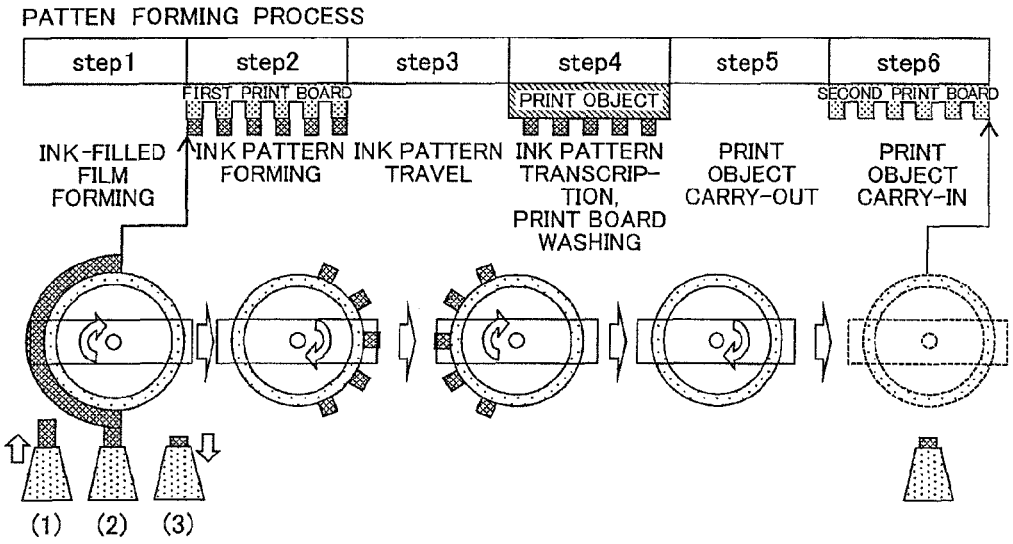
FIG. 5 is a sectional view schematically showing the processes of a printing method using a printing apparatus according to the embodiment 2 of the present invention.

FIG. 5 is a process chart schematically showing a pattern forming process using a printing apparatus and a reverse printing method according to the present embodiment. As shown in the figure, the pattern forming process comprises the six processes below.

1) To form an ink-filled film at the part of a half of the circumferential length on the surface of the print roll. Here, the print roll, the coater, and the printing plate are placed so that the center of the print roll, the center of the slit of the coater, and the front end of the printing plate may align with each other.

2) To form an ink pattern on the surface of the print roll by moving the print roll toward the print object while bringing the printing plate into contact with the ink-filled film formed at the part of the half of the circumferential length of the surface of the print roll and removing the ink of unnecessary parts from the ink-filled film.

3) To move the print roll to a position where the center of the print roll aligns with the front end of the print object while rotating the print roll only a distance corresponding to a half of the circumferential length and prepare to transcribe the ink pattern formed on the surface of the print roll to the print object.

4) To move the print roll while bringing the ink pattern formed on the surface of the print roll into contact with the print object such as a glass substrate and transcribe the ink pattern formed on the surface of the print roll to the print object. At the same time, to wash the ink remaining on the printing plate and dry the printing plate while moving the washer toward the print object.

5) To carry out the print object on which the ink pattern is transcribed and formed.

6) To carry in and set a next print object and prepare for the next pattern forming. At the same time, to move the print roll to a predetermined position above the coater and move the washer to a predetermined standby position on the side of the coater.

The following aspects are considered as the control of the devices such as the print roll, the coater, and the washer in the six processes. The rotation of the print roll and the vertical movement of the slit of the coater in the process 1). The rotation speed and the travel speed of the print roll in the processes 2) and 3). The rotation speed and the travel speed of the print roll, the travel speed of the washer, and the like in the process 4). By controlling the devices with a high degree of accuracy, it is possible not only to operate a printing apparatus continuously but also to form a pattern having the same quality as a photolithography process.

Embodiment 3

The printing apparatus in FIG. 1C comprises a frame 1, a print roll 2, a coater 3, a printing plate 4, a print object 5, a stage 6, a stage 7, washing devices 9, a dryer 10, a cleaning agent recovery device 11, and a washer 12. Here, the frame 1 is not essential for the printing apparatus. In FIG. 1C, a fixed base 8*a* is placed at the upper part of the frame 1. The fixed base 8*a* is referred to as a first base. A fixed base 8*b* is placed at the lower part of the frame 1. In other words, the fixed base 8*b* is placed below the print roll 2. The fixed base 8*b* is referred to as a second base. The stage 6 is tightly placed on the bottom face of the upper fixed base 8*a*. The printing plate 4 is placed on the bottom face of the stage 6 in a sticking manner. Consequently, the upper fixed base section has the fixed base 8*a*, the stage 6, and the printing plate 4.

The stage 7 is tightly placed on the top face of the lower fixed base 8*b*. The print object 5 is placed on the top face of the stage 7 in a sucking manner so that the distance between the rear end of the printing plate 4 and the front end of the print object 5 may be equal to the lengths of the printing plate 4 and the print object 5. Consequently, the lower fixed base section has the fixed base 8*b*, the stage 7, and the print object 5. In other words, the stage 7 is placed on the bottom face of the print object 5.

The print roll 2 and the washer 12 having movable function of traveling using the top face or the bottom face of the frame 1 as a guide are placed. The washer 12 comprises two washing devices 9, one dryer 10, and one cleaning agent recovery device 11. The coater 3 is tightly placed so that the distance between the front end of the printing plate 4 below the frame 1 and the center of the slit 3*c* may be equal to the length of the printing plate. This is a printing apparatus of a type of moving the print roll 2 and the washer 12.

Here, although two washing devices 9 are placed in FIG. 10, the present invention is not limited to this case and one washing device or plural washing devices may also be placed. Further, although the coater 3 is placed so that the distance between the front end of the printing plate 4 and the center of the slit 3*c* may be equal to the lengths of the printing plate 4 and the print object 5 in FIG. 10, the present invention is not limited to this case and the coater may be placed so that the front end of the printing plate 4 may align with the center of the slit 3*c*. On this occasion, the printing plate 4 and the print object 5 may be placed so that the rear end of the printing plate 4 may align with the front end of the print object 5.

By placing the printing plate 4 above the print roll 2 so that the print face of the printing plate 4 may be directed downward and further placing the washer 12 for washing and drying the printing plate 4 below the printing plate 4 as shown in FIG. 1C, it is possible to adopt a jet washing method known as a simple liquid washing method. Further, it is possible: not only to wash the printing plate with a high degree of cleanliness; but also to cope with the formation of a minute pattern 10 microns or less in pattern width and form a pattern of a high fineness, a high reproducibility, and a high operation rate.

In particular, since a pattern is formed not only by moving the print roll and the washer but also by placing the print object 5 below the print roll 2, it is possible to wash the printing plate plural times. Consequently, it is possible to use a simple apparatus that can form a pattern of a high fineness stably with a high degree of reproducibility and reduce the cost of the carry-in and carry-out of the print object.

Further, in forming a pattern, since a pattern is formed by using a half of the circumferential length of the print roll, it is possible to prolong the lifespan of a blanket being mounted on the surface of the print roll and having silicone rubber on the outermost surface. Furthermore, since the area where the print roll touches the printing plate increases by increasing the diameter of the print roll and thereby the deformation of the blanket caused by compression stress reduces, it is possible to reduce the depth of the recesses of the printing plate.

In addition, the cleaning agent recovery device not only recovers a cleaning agent but also plays the role of preventing the cleaning agent from scattering to the print roll and the print object and hence it is possible to steadily form a pattern of a high fineness, a high reproducibility, and a high operation rate.

FIGS. 6A to 6D are sectional views schematically showing the processes of a printing method shown in FIG. 1C.

Figure 6A:
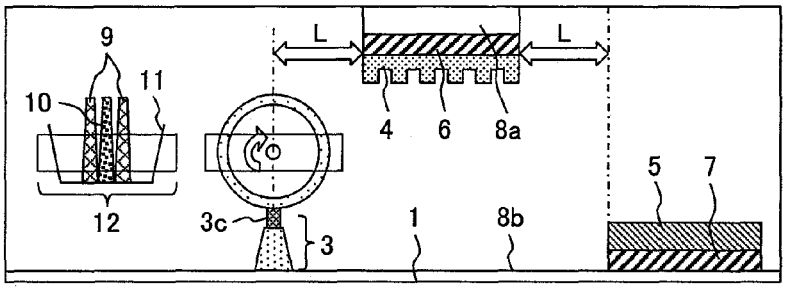
FIGS. 6A to 6D are sectional views schematically showing a printing apparatus according to the embodiment 3 of the present invention.

The process of forming an ink-filled film 13 on the surface of the print roll 2 shown in FIG. 6A is as follows. The slit 3*c* of the coater 3 placed below the print roll 2 on which a silicone rubber blanket is mounted touches the print roll 2 by moving upward. Successively, an ink-filled film 13 of a predetermined thickness is formed by rotating the print roll 2 at a rotation frequency that allows a film of a predetermined thickness to be formed in the state of moving downward and fixing the slit 3*c* so as to set the space between the surface of the print roll 2 and the slit 3*c* at a predetermined value.

Here, in the process of forming an ink-filled film 13 on the surface of the print roll 2, the printing plate 4 placed on the fixed base 8*a*, the print roll 2, and the coater 3 placed on the fixed base 8*b* are placed so that the distance L from the front end of the printing plate 4 to the center of the print roll 2 and the center of the slit 3*c* may be equal to the length of the printing plate 4.

Further, the length of the printing plate 4, the length of the print object 5, and the distance L from the rear end of the printing plate 4 to the front end of the print object 5 are equal to a half of the circumferential length of the print roll 2.

Figure 6B:
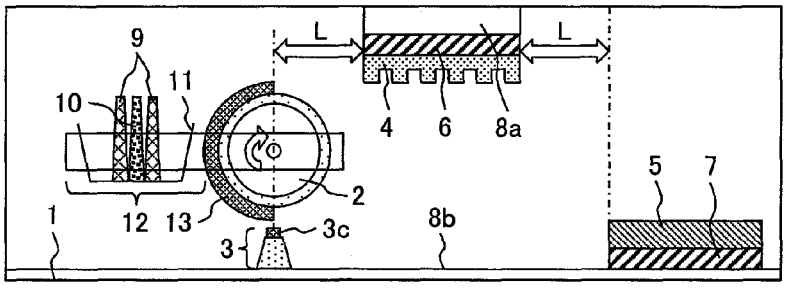

Successively, the process of forming an ink pattern 13*a* on the surface of the print roll 2 shown in FIG. 6B is as follows. The head of the ink-filled film 13 formed on the surface of the print roll 2 reaches the front end of the printing plate 4 and touches the printing plate 4. At the same time, the print roll 2 starts to move toward the print object 5, the ink at the part touching the protrusions of the printing plate 4 is removed from the ink-filled film 13 formed on the surface of the print roll 2, and an ink pattern 13*a* is formed on the surface of the print roll 2.

With regard to the print roll 2 here, simultaneously with the end of the formation of the ink pattern 13*a*, the print roll 2 stops to rotate and immediately moves in the state of being able to transcribe the ink pattern to the print object 5.

Simultaneously with the end of the formation of the ink pattern 13*a*, the washer 12 comprising the two washing devices 9, the dryer 10, and the cleaning agent recovery device 11 starts to move toward the printing plate 4 in order to wash the ink remaining on the printing plate 4.

Further, the ink pattern 13*a* formed on the surface of the print roll 2 corresponds to the concave pattern part formed on the printing plate 4. It is important to set the depth of the recesses of the printing plate 4 so that the ink-filled film 13 may not touch the bottom face of the concave pattern formed on the printing plate 4 when the printing plate 4 touches the ink-filled film 13 formed on the surface of the print roll 2.

Figure 6C:
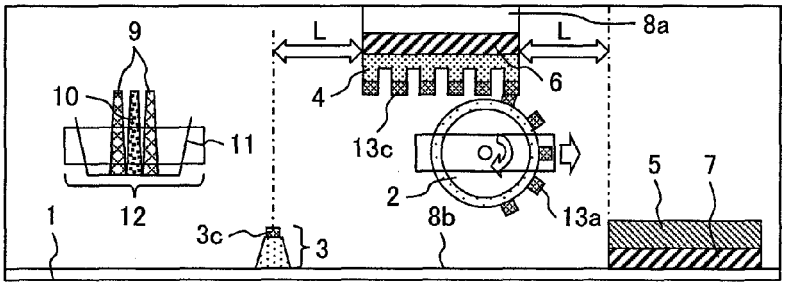

Successively, the process of transcribing the ink pattern 13*a* formed on the surface of the print roll 2 to the print object 5 and removing and washing the ink 13*c* remaining on the printing plate 4 shown in FIG. 6C is as follows. The ink pattern 13*a* formed on the surface of the print roll 2 touches the print object 5 and the transcription starts. At the same time, the washer 12 that has moved to the front end of the printing plate 4 starts washing. The whole ink pattern 13*a* formed on the surface of the print roll 2 is transcribed to the print object 5 and thus the transcription of the ink pattern 13*a* is completed. At the same time, the removal and washing of the ink 13*c* remaining on the printing plate 4 with the washer 12 are also completed.

Figure 6D:
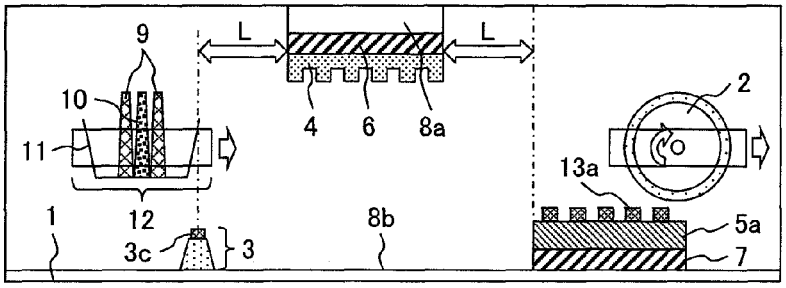

Successively, the process of carrying out the print object 5*a* to which the ink pattern is transcribed and carrying in a next print object 5 shown in FIG. 6D is as follows. The print roll 2 moves to a position where the center of the print roll 2 aligns with the rear end of the printing plate 4 on the extension of the center line of the slit 3*c* of the coater 3 and stops. At the same time, the washer 12 moves to a predetermined standby position on the side of the coater 3 and stops. The print object 5*a* to which the ink pattern 13*a* is transcribed is carried out, a next print object is carried in and set, and the forward pattern forming process finishes.

By repeating the above processes, it is possible to form a pattern of a high print reproducibility and a high operation rate at a low cost. Further, even in the case of using a printing plate 10 microns or less in pattern width that has been regarded as hardly washable with a liquid, it is possible to wash the printing plate with a high degree of cleanliness and stably form a pattern of a high print reproducibility.

Further, a feature of the present embodiment is that, in the forward and backward pattern forming, since a pattern is formed by using a half periphery of the silicone rubber blanket mounted on the surface of the print roll respectively, the lifespan of the silicone rubber blanket is long.

Furthermore, another feature of the present embodiment is that, by placing the print object 5 and the stage 7 for the print object below the print roll 2, it is possible to simplify devices related to the disposition, carry-in, and carry-out of the print object 5.

Here, although a coater is placed in the present embodiment, the present invention is not limited to the present embodiment and plural device may be placed. Further, the same is applied to the washer too and not only the washer may comprise one washing device and one dryer but also an identical printing plate may be washed twice.

Figure 7:
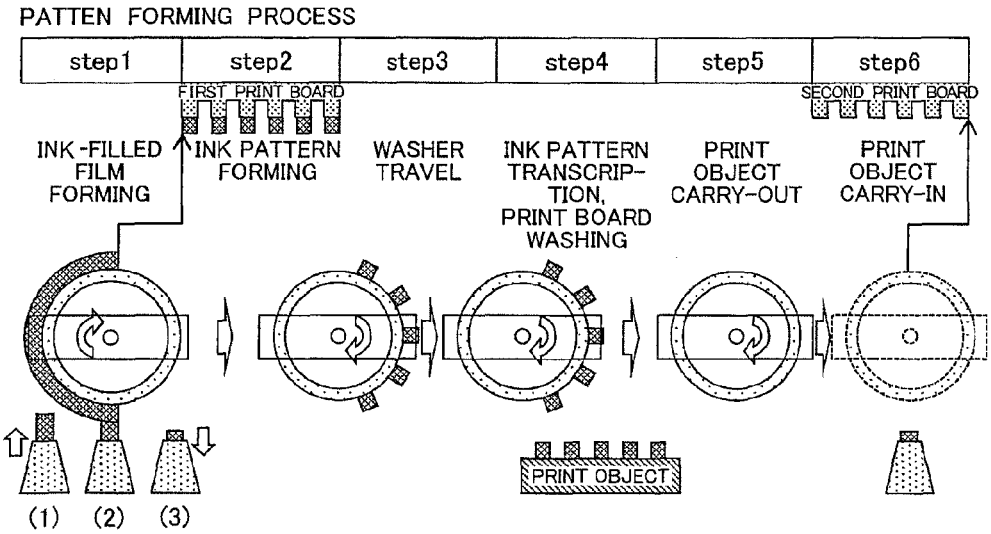
FIG. 7 is a sectional view schematically showing the processes of a printing method using a printing apparatus according to the embodiment 3 of the present invention.

FIG. 7 is a process chart schematically showing a pattern forming process using a printing apparatus and a reverse printing method according to the present embodiment. As shown in the figure, the pattern forming process comprises the six processes below.

1) To form an ink-filled film at the part of a half of the circumferential length on the surface of the print roll. Here, the print roll, the coater, and the printing plate are placed so that the distance from the center of the print roll and the center of the slit of the coater to the front end of the printing plate may be equal to the length of the printing plate.

2) To form an ink pattern on the surface of the print roll by moving the print roll toward the print object while bringing the printing plate into contact with the ink-filled film formed at the part of the half of the circumferential length of the surface of the print roll and removing the ink of unnecessary parts from the ink-filled film.

3) To move the print roll to a position where the center of the print roll aligns with the front end of the print object in the state of stopping the rotation of the print roll and prepare to transcribe the ink pattern formed on the surface of the print roll to the print object.

4) To rotationally move the print roll while bringing the ink pattern formed on the surface of the print roll into contact with the print object such as a glass substrate and transcribe the ink pattern formed on the surface of the print roll to the print object. At the same time, to remove and wash the ink remaining on the printing plate while moving the washer toward the print object.

5) To carry out the print object on which the ink pattern is transcribed and formed.

6) To carry in and set a next print object and prepare for the backward pattern forming. At the same time, to move the print roll to a predetermined position above the coater and move the washer to a predetermined standby position on the side of the coater.

The following aspects are considered as the control of the devices such as the print roll, the coater, and the washer in the six processes. The rotation of the print roll and the vertical movement of the slit of the coater in the process 1). The rotation speed and the travel speed of the print roll in the processes 2) and 3). The rotation speed and the travel speed of the print roll, the travel speed of the washer, and the like in the process 4). By controlling the devices with a high degree of accuracy, it is possible not only to operate a printing apparatus continuously but also to form a pattern having the same quality as a photolithography process.

Embodiment 4

Figure 8A:
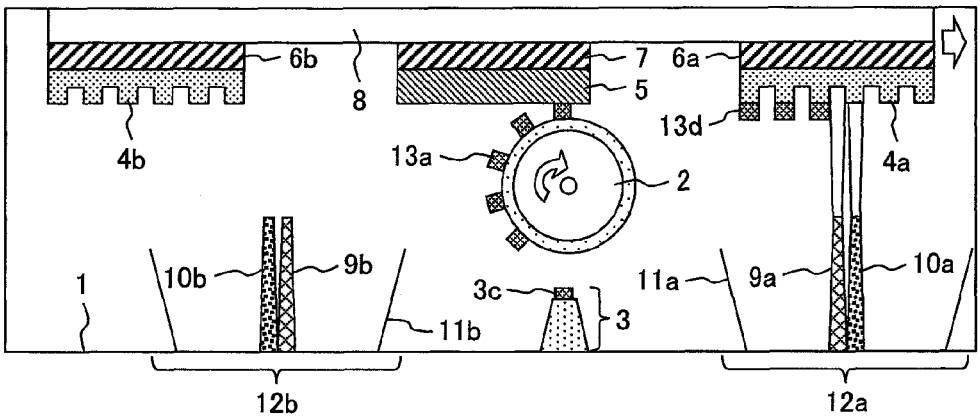
FIG. 8A is a sectional view schematically showing printing apparatuses according to embodiment 4 of the present invention.

FIG. 8A is a sectional view schematically showing a printing apparatus using a reverse printing method according to the present embodiment. The printing apparatus in FIG. 8A comprises a frame 1, a print roll 2, a coater 3, printing plates

4*a* and 4*b*, a print object 5, stages 6*a* and 6*b*, a stage 7, a movable base 8, washing devices 9*a* and 9*b*, dryers 10*a* and 10*b*, cleaning agent recovery devices 11*a* and 11*b*, and washers 12*a* and 12*b*. Here, the frame 1 is not essential for the printing apparatus.

In FIG. 8A, the movable base 8 is placed at the upper part of the frame 1 and the stages 6*a*, 6*b*, and 7 are tightly placed on the bottom face of the movable base 8. In other words, the movable base 8 is placed above the print roll 2 and also the stage 6*b* is placed on the bottom face of the movable base 8. The stage 6*a* is referred to as a first stage, the stage 7 as a second stage, and the stage 6*b* as a third stage. The printing plates 4*a* and 4*b* and the print object 5 are placed on the bottom faces of the stages 6*a*, 6*b*, and 7 in a sticking manner. The coater 3 is tightly placed below the print roll 2. The washers 12*a* and 12*b* are tightly placed at the lower part of the frame 1 on both the sides of the print roll 2.

The washer 12*a* comprises the washing device 9*a*, the dryer 10*a*, and the cleaning agent recovery device 11*a*. The washer 12*b* comprises the washing device 9*b*, the dryer 10*b*, and the cleaning agent recovery device 11*b*. The printing apparatus in FIG. 8A is a type of moving the printing plates 4*a* and 4*b* and the print object 5. The spray nozzles of the washing devices 9*a* and 9*b* are directed to the side where the movable base 8 exists.

Here, although the two washers are fixed in FIG. 8A, the present invention is not limited to the case and a movable washer may be placed.

As shown in FIG. 8A, the printing plates 4*a* and 4*b* are placed above the print roll 2 and the print faces of the printing plates 4*a* and 4*b* are directed downward. The washers 12*a* and 12*b* for washing and drying the printing plates 4*a* and 4*b* are placed below the printing plates 4*a* and 4*b*. By so doing, it is possible to adopt a jet washing method known as a simple liquid washing method and wash the printing plates with a high degree of cleanliness for a short period of time. Further, it is possible to cope with the formation of a minute pattern 10 microns or less in pattern width and form a pattern of a high fineness, a high reproducibility, and a high operation rate.

Further, in each of the forward and backward pattern forming, since a pattern is formed by using a half of the circumferential length of the print roll, it is possible to prolong the lifespan of a blanket being mounted on the surface of the print roll and having silicone rubber on the outermost surface. Furthermore, since the area where the print roll touches a printing plate increases by increasing the diameter of the print roll and thereby the deformation of the blanket caused by compression stress reduces, it is possible to reduce the depth of the recesses of the printing plate.

FIGS. 9A to 9H are sectional views schematically showing the processes of a printing method shown in FIG. 8A. The pattern forming processes shown in FIGS. 9A to 9D represent the forward movement and the pattern forming processes shown in FIGS. 9E to 9H represent the backward movement.

Figure 9A:
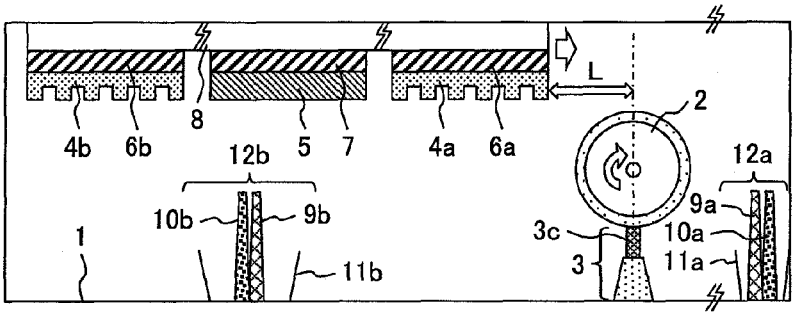
FIG. 9A to 9H are sectional views schematically showing a printing apparatus according to the embodiment 4 of the present invention.

Firstly, the forward process of forming a pattern while moving the printing plate 4*a* and the print object 5 placed on the movable base 8 toward the right relative to the print roll 2 is explained. The process of forming an ink-filled film 13 on the surface of the print roll 2 shown in FIG. 9A is as follows. The slit 3*c* of the coater 3 placed below the print roll 2 on which the silicone rubber blanket is mounted moves upward and touches the print roll 2. Thereafter, the slit 3*c* moves downward so that the space between the surface of the print roll 2 and the slit 3*c* may be a predetermined value, the print roll 2 rotates at a predetermined rotation frequency in a fixed state, and thereby an ink-filled film of a desired thickness is formed.

Here, in the process of forming the ink-filled film 13 on the surface of the print roll 2, the length L between the printing plate 4*a* placed on the movable base 8 and the center of the slit 3*c* is equal to a half of the circumferential length of the print roll 2. Further, the lengths of the printing plates 4*a* and 4*b* are also equal to a half of the circumferential length of the print roll 2.

Further, the rotation speed of the print roll 2 is identical to the travel speed of the movable base 8 on which the printing plates 4*a* and 4*b* and the print object 5 are placed and the start of the rotation synchronizes with the start of the travel.

Furthermore, the distance from the rear end of the printing plate 4*a* to the front end of the print object 5 is equal to a half of the circumferential length of the print roll 2. The length of the print object 5, the length of the printing plate 4*b*, and the distance from the rear end of the print object 5 to the front end of the printing plate 4*b* are also equal to a half of the circumferential length of the print roll 2.

Figure 9B:
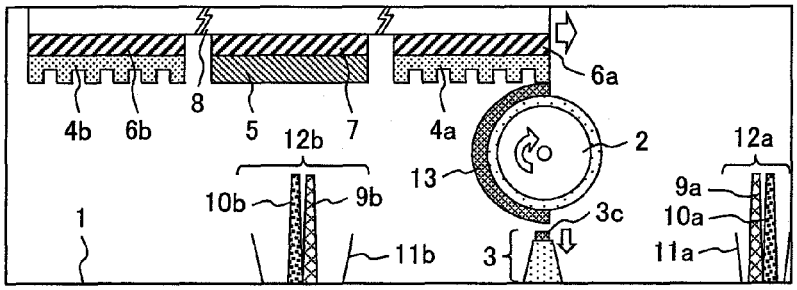

Successively, the process of forming an ink pattern 13*a* on the surface of the print roll 2 shown in FIG. 9B is as follows. The ink-filled film 13 touches the printing plate 4*a* when the front end of the ink-filled film 13 formed on the surface of the print roll 2 reaches the center of the slit 3*c* of the coater 3. The ink at the part touching the protrusions of the printing plate 4*a* is removed from the ink-filled film 13 formed on the surface of the print roll 2 and an ink pattern 13*a* is formed on the surface of the print roll 2.

Here, the ink pattern 13*a* formed on the surface of the print roll 2 corresponds to the concave pattern formed on the printing plate 4*a*. It is important to set the depth of the recesses of the printing plate 4*a* so that the ink-filled film 13 may not touch the bottom face of the concave pattern formed on the printing plate 4*a* when the printing plate 4*a* touches the ink-filled film 13 formed on the surface of the print roll 2.

Figure 9C:
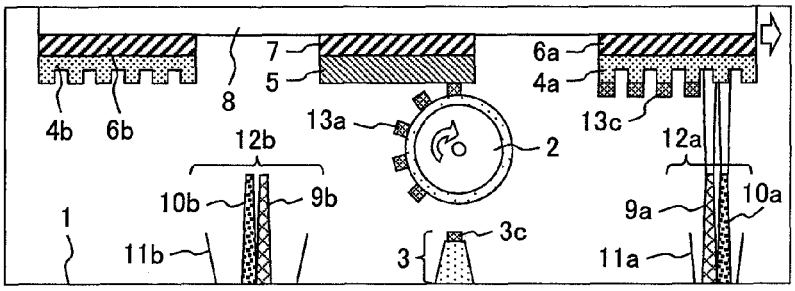

Successively, the process of transcribing the ink pattern 13*a* formed on the surface of the print roll 2 to the print object 5 and removing and washing the ink remaining on the printing plate 4*a* shown in FIG. 9C is as follows. The washing starts simultaneously when the front end of the printing plate 4*a* reaches the position where the washing device 9*a* is placed. At the same time, the ink pattern 13*a* is transcribed to the print object 5 simultaneously when the front end of the print object 5 touches the head pattern of the ink pattern 13*a* formed on the print roll 2. Further, the transcription of the ink pattern 13*c* to the print object 5 is completed simultaneously when the removal and washing of the ink 13*c* remaining on the printing plate 4*a* are completed.

Figure 9D:
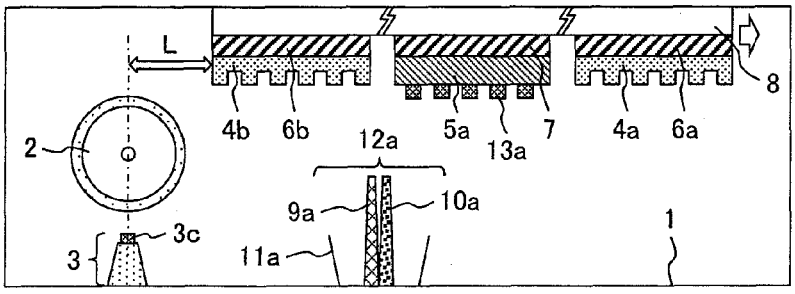

Successively, the process of carrying out the print object 5*a* to which the ink pattern is transcribed and carrying in a next print object 5 shown in FIG. 9D is as follows. The movable base 8 stops when the distance from the rear end of the printing plate 4*b* to the extension of the center line of the slit 3*c* of the coater 3 comes to be equal to a half of the circumferential length of the print roll. Then the print object 5*a* to which the ink pattern is transcribed is carried out, a next print object is carried in and set, and the forward pattern forming process finishes.

Figure 9E:
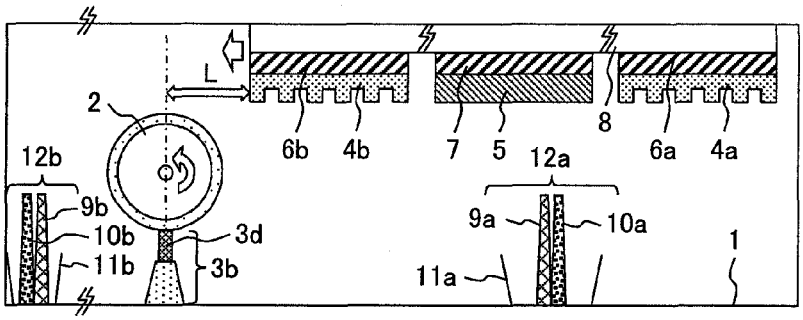

Secondly, the backward process of forming a pattern while moving the printing plate and the print object placed on the movable base 8 toward the left relative to the print roll is explained. The process of forming an ink-filled film on the surface of the print roll shown in FIG. 9E is as follows. The slit 3*c* of the coater 3 placed below the print roll 2 on which the silicone rubber blanket is mounted moves upward and touches the print roll 2. Thereafter, the slit 3*c* moves downward so that the space between the surface of the print roll 2 and the slit 3*c* may be a predetermined value, the print roll 2 rotates at a predetermined rotation frequency in a fixed state, and an ink-filled film 13 of a desired thickness is formed.

Here, in the process of forming the ink-filled film on the surface of the print roll 2, the distance L from the head of the printing plate 4*b* placed on the movable base 8 to the extension of the slit center line of the coater 3 is equal to a half of the circumferential length of the print roll 2.

Figure 9F:
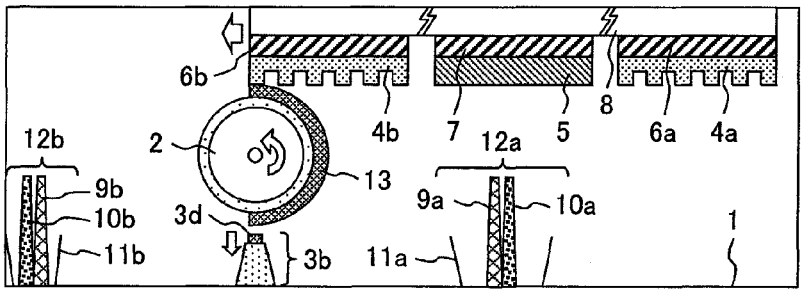

Successively, the process of forming an ink pattern 13*b* on the surface of the print roll 2 shown in FIG. 9F is as follows. The ink-filled film 13 touches the printing plate 4*b* when the head of the ink-filled film 13 formed on the surface of the print roll 2 reaches the extension of the center line of the slit of the coater 3. The ink at the part touching the protrusions of the printing plate 4*b* is removed from the ink-filled film 13 formed on the surface of the print roll 2 and an ink pattern 13*b* is formed on the surface of the print roll 2.

Here, the ink pattern 13*b* formed on the surface of the print roll 2 corresponds to the concave pattern formed on the printing plate 4*b*. It is important to set the depth of the recesses of the printing plate 4*b* so that the ink-filled film 13 may not touch the bottom face of the concave pattern formed on the printing plate 4*b* when the printing plate 4*b* touches the ink-filled film 13 formed on the surface of the print roll 2.

Figure 9G:
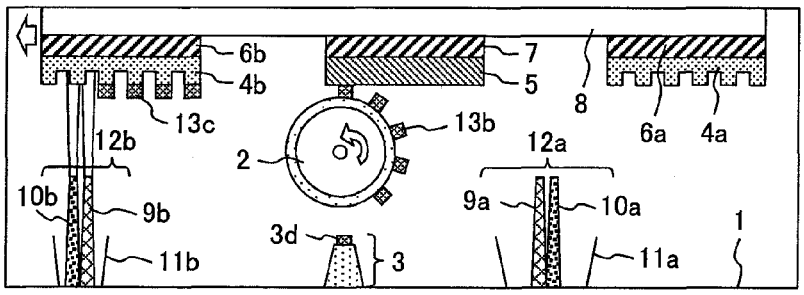

Successively, the process of transcribing the ink pattern 13*b* formed on the surface of the print roll 2 to the print object 5 and removing the ink remaining on the printing plate 4*b* shown in FIG. 9G is as follows. The washing starts simultaneously when the head of the printing plate 4*b* reaches the position where the washing device 9*b* is placed. At the same time, the head of the print object 5 touches the head pattern of the ink pattern 13*b* formed on the print roll 2 and the ink pattern 13*b* is transcribed to the print object 5. Further, the transcription of the ink pattern 13*b* to the print object 5 is completed simultaneously when the washing and drying of the printing plate 4*b* are completed.

Figure 9H:
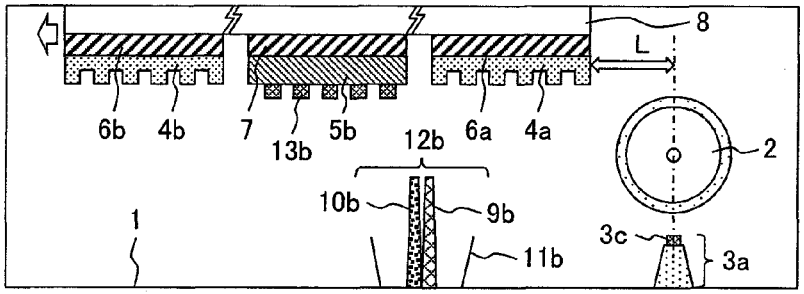

Successively, the process of carrying out the print object 5*b* to which the ink pattern is transcribed and carrying in a next print object 5 shown in FIG. 9H is as follows. The movable base 8 stops when the distance from the rear end of the printing plate 4*a* to the extension of the center line of the slit 3*c* of the coater 3 comes to be equal to a half of the circumferential length of the print roll. Then the print object 5*b* to which the ink pattern is transcribed is carried out, a next print object is carried in and set, and the backward pattern forming process finishes.

By repeating the above processes, it is possible to form a pattern of a high print reproducibility and a high operation rate at a low cost. Further, even in the case of using a printing plate 10 microns or less in pattern width that has been regarded as hardly washable with a liquid, it is possible to wash the printing plate with a high degree of cleanliness and stably form a pattern of a high print reproducibility.

Further, a feature of the present embodiment is that, since a pattern is formed by using a half periphery of the silicone rubber blanket mounted on the surface of the print roll in each of the forward and backward pattern forming, the lifespan of the silicone rubber blanket is long.

Figure 10A:
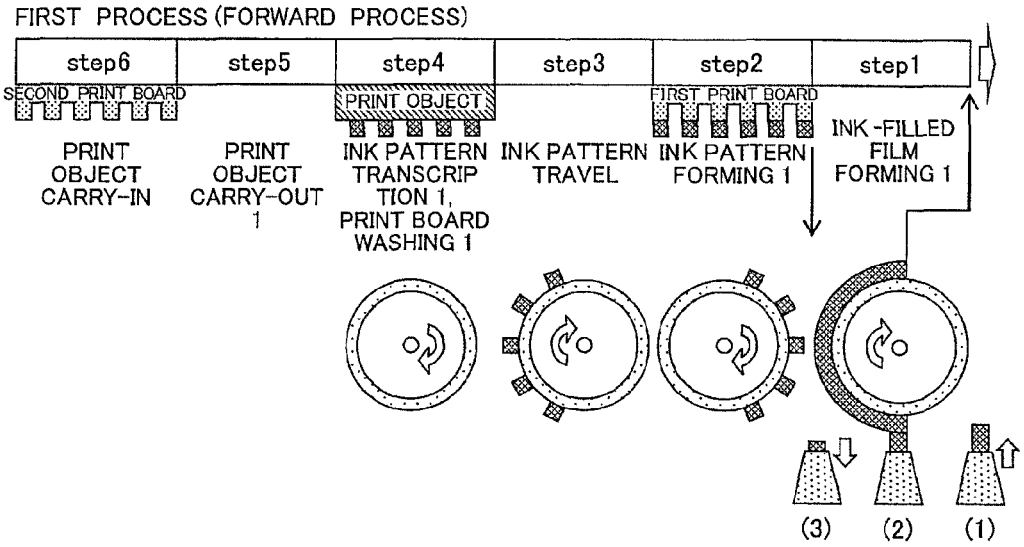
FIGS. 10A and 10B are sectional views schematically showing the processes of a printing method using a printing apparatus according to the embodiment 4 of the present invention.
Figure 10B:
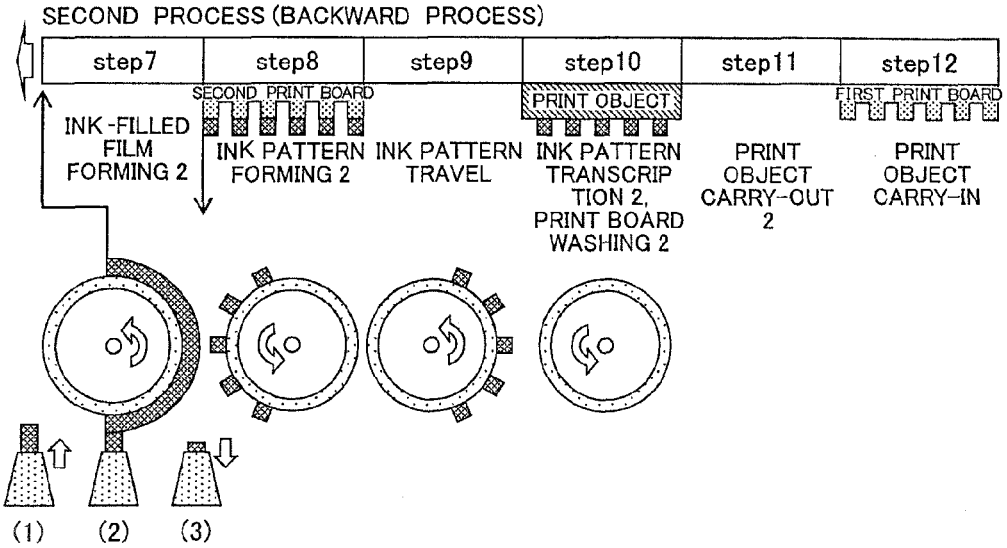

FIGS. 10A and 10B are process charts schematically showing pattern forming processes using a printing apparatus and a reverse printing method according to the present embodiment. FIG. 10A represents a forward pattern forming process (the movable base 8 having the printing plates and the print object moves rightward in the figure) and FIG. 10B represents a backward pattern forming process (the movable base 8 having the printing plates and the print object moves leftward in the figure). As shown in FIGS. 10A and 10B, each of the forward and backward pattern forming processes comprises the six processes below.

1) To form an ink-filled film at the part of a half of the circumferential length on the surface of the print roll. At the same time, to move the movable base 8 at which the printing plates and the print object are set only a distance corresponding to a half of the circumferential length of the print roll.

2) To form an ink pattern on the surface of the print roll by bringing the printing plate into contact with the ink-filled film formed at the part of the half of the circumferential length of the surface of the print roll and removing the ink of unnecessary parts from the ink-filled film.

3) To prepare to transcribe the ink pattern to the print object by rotating the print roll only a distance corresponding to a half of the circumferential length.

4) To transcribe the ink pattern to the print object by bringing the ink pattern formed on the surface of the print roll into contact with the print object such as a glass substrate. At the same time, to wash the ink remaining on the printing plate with the washer and dry the printing plate.

5) To carry out the print object on which the ink pattern is formed.

6) To carry in and set a next print object and prepare for the backward pattern forming.

The following aspects are considered as the control of the devices such as the print roll, the coater, the movable base at which the printing plates and the print object are set, and the washer in the six processes. In the process 1), the rotation speed of the print roll is equal to the travel speed of the movable base at which the printing plates and the print object are set and the rotation and the travel start simultaneously. In the process 2), simultaneously with the commencement of ink pattern forming, the slit of the coater descends downward and the ink-filled film stops to form. In the process 4), simultaneously with the commencement of the transcription of the ink pattern, the washer starts to wash the printing plate. By controlling the devices with a high degree of accuracy, it is possible not only to operate a printing apparatus continuously but also to form a pattern having the same quality as a photolithography process.

Embodiment 5

Figure 8B:
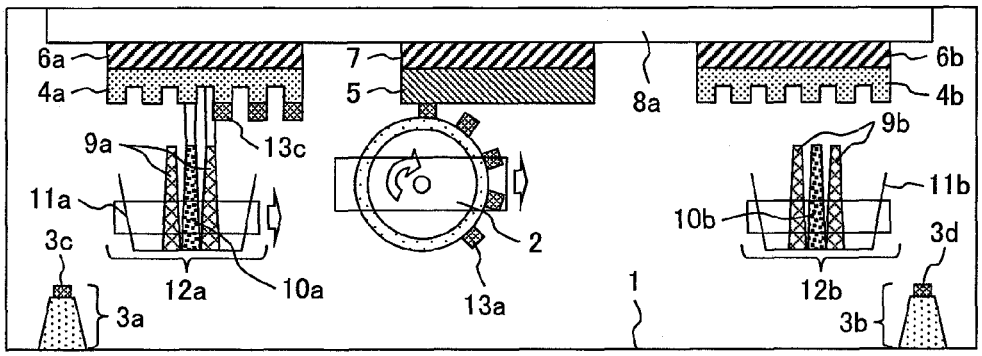
FIG. 8B is a sectional view schematically showing printing apparatuses according to embodiment 5 of the present invention.

FIG. 8B is a sectional view schematically showing a printing apparatus using a reverse printing method according to the present embodiment. The printing apparatus in FIG. 8B comprises a frame 1, a print roll 2, coaters 3, printing plates 4*a* and 4*b*, a print object 5, stages 6*a* and 6*b*, a stage 7, a fixed base 8*a*, washing devices 9*a* and 9*b*, dryers 10*a* and 10*b*, cleaning agent recovery devices 11*a* and 11*b*, and washers 12*a* and 12*b*. Here, the frame 1 is not essential for the printing apparatus.

In FIG. 8B, the fixed base 8*a* is placed at the upper part of the frame 1. The stages 6*a*, 6*b*, and 7 are tightly placed on the bottom face of the fixed base 8*a*. The printing plates 4*a* and 4*b* and the print object 5 are placed on the bottom faces of the stages 6*a*, 6*b*, and 7 in a sticking manner. That is, the fixed base section comprises the fixed base 8*a*, the stages 6*a* and 6*b*, the stage 7, the printing plates 4*a* and 4*b*, and the print object 5.

The print roll 2 and the washers 12*a* and 12*b* having movable function of traveling using the top face or the bottom face of the frame 1 as a guide are placed. The washer 12*a* comprises the washing devices 9*a*, the dryer 10*a*, and the cleaning agent recovery device 11*a*. The washer 12*b* comprises the washing devices 9*b*, the dryer 10*b*, and the cleaning agent recovery device 11*b*. The coaters 3*a* and 3*b* are tightly placed so that the front ends of the printing plates 4*a* and 4*b* may align with the centers of the slits 3*c* and 3*d* respectively below the frame 1. The printing apparatus in FIG. 8B is a type of moving the print roll 2 and the washers 12*a* and 12*b*.

Here, although two washers are placed in FIG. 8B, the present invention is not limited to this case and only one washer may be placed.

As shown in FIG. 8B, the printing plates 4*a* and 4*b* are placed above the print roll 2. Then the print faces of the printing plates 4*a* and 4*b* are directed downward. Further, the washers 12*a* and 12*b* for washing and drying the printing plates 4*a* and 4*b* are placed below the printing plates 4*a* and 4*b* and thereby it is possible to adopt a jet washing method known as a simple liquid washing method and wash the printing plates with a high degree of cleanliness for a short period of time. Moreover, it is possible to cope with the formation of a minute pattern 10 microns or less in pattern width and form a pattern of a high fineness, a high reproducibility, and a high operation rate.

Further, in each of the forward and backward pattern forming, since a pattern is formed by using a half of the circumferential length of the print roll, it is possible to prolong the lifespan of a blanket being mounted on the surface of the print roll and having silicone rubber on the outermost surface. Furthermore, since the area where the print roll touches a printing plate increases by increasing the diameter of the print roll and thereby the deformation of the blanket caused by compression stress reduces, it is possible to reduce the depth of the recesses of the printing plate.

FIGS. 11A to 11H are sectional views schematically showing the processes of a printing method shown in FIG. 8B. The pattern forming processes shown in FIGS. 11A to 11D represent the forward movement and the pattern forming processes shown in FIGS. 11E to 11H represent the backward movement.

Figure 11A:
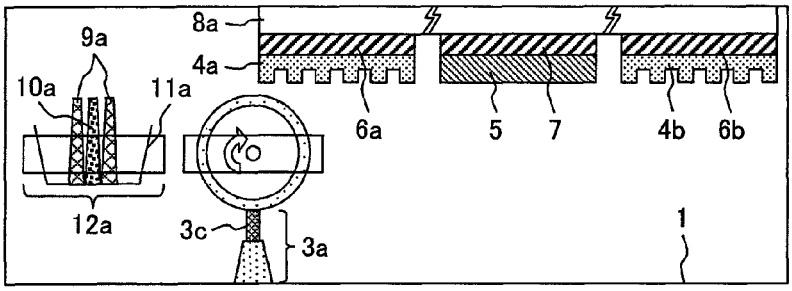
FIG. 11A to 11H are sectional views schematically showing a printing apparatus according to the embodiment 5 of the present invention.

Firstly, the forward process of forming a pattern while moving the print roll 2 and the washer 12*a* toward the right in the figure is explained. The process of forming an ink-filled film on the surface of the print roll 2 shown in FIG. 11A is as follows. The slit 3*c* of the coater 3*a* placed below the print roll 2 on which the silicone rubber blanket is mounted moves upward and touches the print roll 2. Thereafter, the slit 3*c* moves downward so that the space between the surface of the print roll 2 and the slit 3*c* may be a predetermined value, the print roll 2 rotates at a rotation frequency that allows a film of a predetermined thickness to be formed in a fixed state, and thereby an ink-filled film 13 of a desired thickness is formed.

Here, in the process of forming the ink-filled film 13 on the surface of the print roll 2, the printing plate 4*a* placed on the fixed base 8*a*, the print roll 2, and the coater 3*a* are placed so that the front end of the printing plate 4*a*, the center of the print roll 2, and the center of the slit 3*c* may nearly align with each other.

Further, the length of the printing plate 4*a*, the length of the printing plate 4*b*, the length of the print object 5, the distance between the rear end of the printing plate 4*a* and the front end of the print object 5, and the distance between the front end of the printing plate 4*b* and the front end of the print object 5 are equal to a half of the circumferential length of the print roll 2.

Figure 11B:
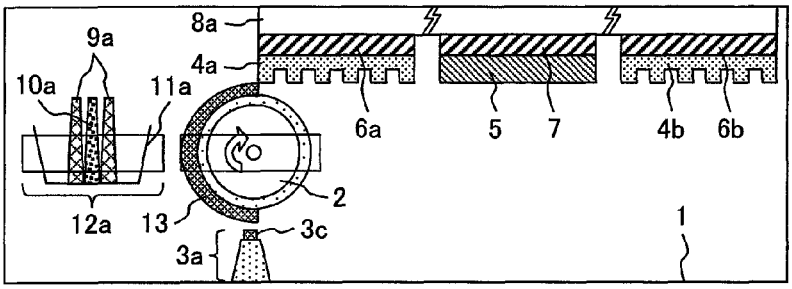

Successively, the process of forming an ink pattern 13*a* on the surface of the print roll 2 shown in FIG. 11B is as follows. The head of the ink-filled film 13 formed on the surface of the print roll 2 reaches the front end of the printing plate 4*a* and the ink-filled film 13 touches the printing plate 4*a*. At the same time, the print roll 2 starts to move toward the print object 5, the ink at the part touching the protrusions of the printing plate 4*a* is removed from the ink-filled film 13 formed on the surface of the print roll 2 and an ink pattern 13*a* is formed on the surface of the print roll 2.

Simultaneously with the end of the formation of the ink pattern 13*a*, the washer 12*a* comprising the two washing devices 9*a*, the dryer 10*a*, and the cleaning agent recovery device 11*a* starts to move toward the printing plate 4*a* in order to wash the ink remaining on the printing plate 4*a*.

Here, the ink pattern 13*a* formed on the surface of the print roll 2 corresponds to the concave pattern part formed on the printing plate 4*a*. It is important to set the depth of the recesses of the printing plate 4*a* so that the ink-filled film 13 may not touch the bottom face of the concave pattern formed on the printing plate 4*a* when the printing plate 4*a* touches the ink-filled film 13 formed on the surface of the print roll 2.

Figure 11C:
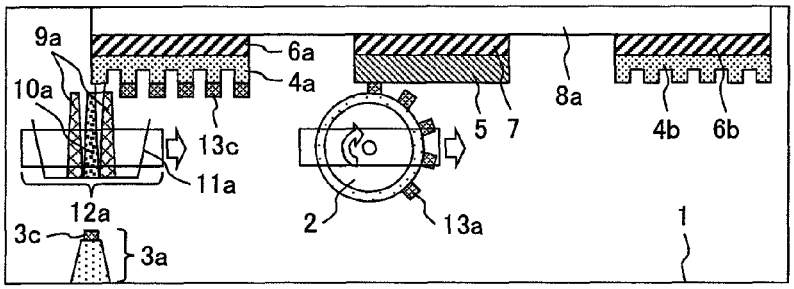

Successively, the process of: transcribing the ink pattern 13*a* formed on the surface of the print roll 2 to the print object 5; and removing and washing the ink remaining on the printing plate 4*a* shown in FIG. 11C is as follows. The ink pattern 13*a* formed on the surface of the print roll 2 touches the print object 5 and is transcribed. At the same time, the washer 12*a* that has moved to the front end of the printing plate 4*a* starts washing. The transcription of the ink pattern 13*a* is completed when the whole ink pattern 13*a* formed on the surface of the print roll 2 is transcribed to the print object 5. At the same time, the removal and washing of the ink remaining on the printing plate 4*a* with the washer 12*a* are also completed.

Figure 11D:
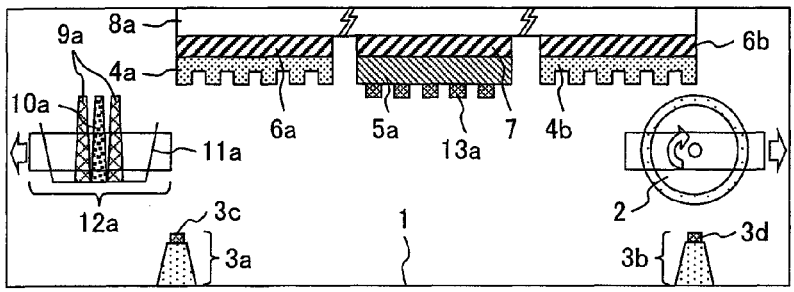

Successively, the process of carrying out the print object 5*a* to which the ink pattern is transcribed and carrying in a next print object 5 shown in FIG. 11D is as follows. The print roll 2 moves to the position where the center of the print roll 2 aligns with the rear end of the printing plate 4*b* on the extension of the center line of the slit 3*d* of the coater 3*b* and stops. At the same time, the washer 12*a* moves to a predetermined standby position on the side of the coater 3*a* and stops. The print object 5*a* to which the ink pattern 13*a* is transcribed is carried out, a next print object is carried in and set, and the forward pattern forming process finishes.

Secondly, the backward process of forming a pattern while moving the print roll 2 toward the left in the figure is explained. The explanations are given briefly since the movement of each device is basically the same as that in the forward process.

Figure 11E:
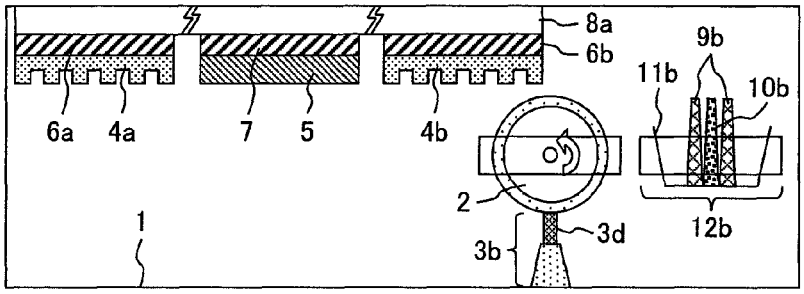

Firstly, the process of forming an ink-filled film 13 on the surface of the print roll 2 shown in FIG. 11E is as follows. The slit 3*d* of the coater 3*b* placed below the print roll 2 on which the silicone rubber blanket is mounted moves upward and touches the print roll 2. Thereafter, the slit 3*d* moves downward so that the space between the surface of the print roll 2 and the slit 3*d* may be a predetermined value, the print roll 2 rotates at a rotation frequency that allows a film of a predetermined thickness to be formed in a fixed state, and thereby an ink-filled film of a desired thickness is formed.

Here, in the process of forming the ink-filled film 13 on the surface of the print roll 2, the printing plate 4*b* placed on the fixed base 8*a*, the print roll 2, and the coater 3*b* are placed so that the front end of the printing plate 4*b*, the center of the print roll 2, and the center of the slit 3*c* may nearly align with each other.

Figure 11F:
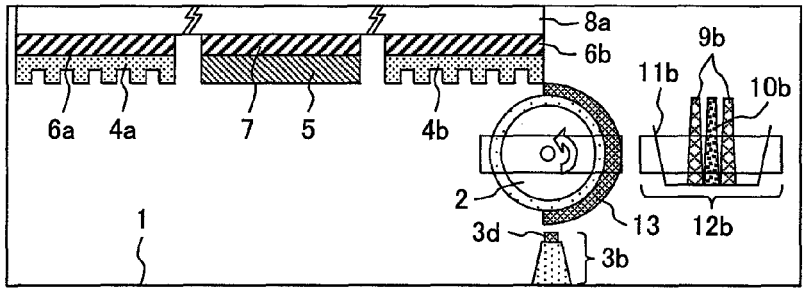

Successively, the process of forming an ink-pattern 13*b* on the surface of the print roll 2 shown in FIG. 11F is as follows. The head of the ink-filled film 13 formed on the surface of the print roll 2 reaches the front end of the printing plate 4*b* and the ink-filled film 13 touches the printing plate 4*b*. At the same time, the print roll 2 starts to move toward the print object 5, the ink at the part touching the protrusions of the printing plate 4*b* is removed from the ink-filled film 13 formed on the surface of the print roll 2, and an ink pattern 13*b* is formed on the surface of the print roll 2.

Simultaneously with the end of the formation of the ink pattern 13*b*, the washer 12*b* comprising the two washing devices 9*b*, the dryer 10*b*, and the cleaning agent recovery device 11*b* starts to move toward the printing plate 4*b* in order to wash the ink remaining on the printing plate 4*b*.

Here, the ink pattern 13*b* formed on the surface of the print roll 2 corresponds to the concave pattern part formed on the printing plate 4*b*. It is important to set the depth of the recesses of the printing plate 4*b* so that the ink-filled film 13 may not touch the bottom face of the concave pattern formed on the printing plate 4*b* when the printing plate 4*b* touches the ink-filled film 13 formed on the surface of the print roll 2.

Figure 11G:
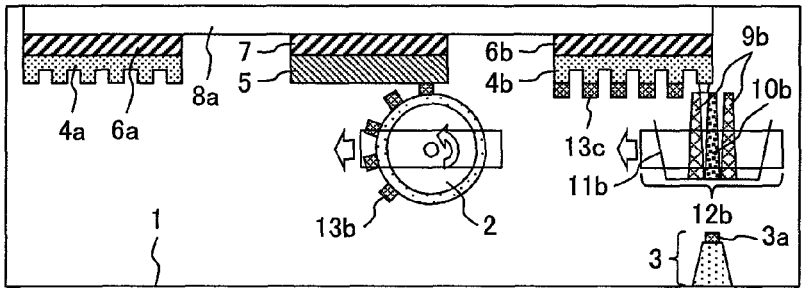

Successively, the process of: transcribing the ink pattern 13*b* formed on the surface of the print roll 2 to the print object 5; and removing and washing the ink remaining on the printing plate 4*b* shown in FIG. 11G is as follows. The ink pattern 13*b* formed on the surface of the print roll 2 touches the print object 5 and starts being transcribed. At the same time, the washer 12*b* that has moved to the front end of the printing plate 4*b* starts washing. The transcription of the ink pattern 13*b* is completed when the whole ink pattern 13*b* formed on the surface of the print roll 2 is transcribed to the print object 5. At the same time, the removal and washing of the ink remaining on the printing plate 4*b* with the washer 12*b* are also completed.

Figure 11H:
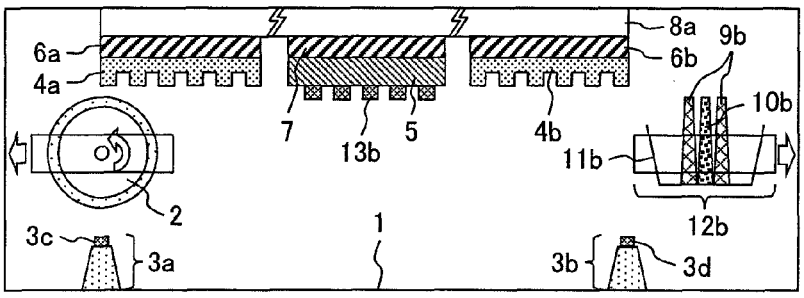

Successively, the process of carrying out the printing plate 5*a* to which the ink pattern 13*b* is transcribed and carrying in a next print object 5 shown in FIG. 11H is as follows. The print roll 2 moves to a position where the center of the print roll 2 aligns with the rear end of the printing plate 4*a* on the extension of the center line of the slit 3*c* of the coater 3*a* and stops. At the same time, the washer 12*b* moves to a predetermined standby position on the side of the coater 3*b* and stops. The print object 5*a* to which the ink pattern 13*b* is transcribed is carried out, a next print object is carried in and set, and the backward pattern forming process finishes.

By repeating the above processes, it is possible to form a pattern of a high print reproducibility and a high operation rate at a low cost. Further, a feature of the present embodiment is that, even in the case of using a printing plate 10 microns or less in pattern width that has been regarded as hardly washable with a liquid, it is possible to wash the printing plate with a high degree of cleanliness and form a stable pattern of a high print reproducibility.

Further, another feature of the present embodiment is that, since a pattern is formed by using a half periphery of the silicone rubber blanket mounted on the surface of the print roll in each of the forward and backward pattern forming, the lifespan of the silicone rubber blanket is long.

Figure 12A:
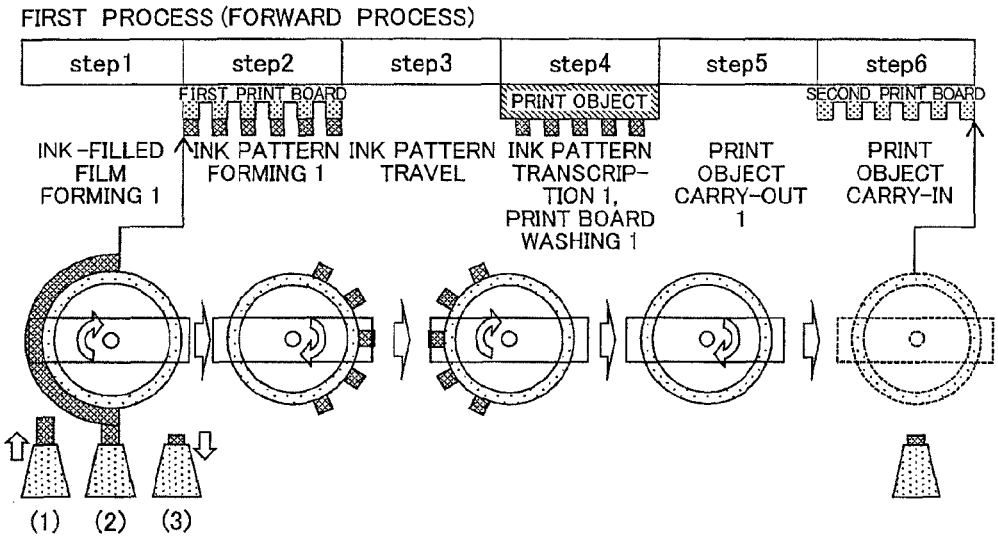
FIGS. 12A and 12B are sectional views schematically showing the processes of a printing method using a printing apparatus according to the embodiment 5 of the present invention.
Figure 12B:
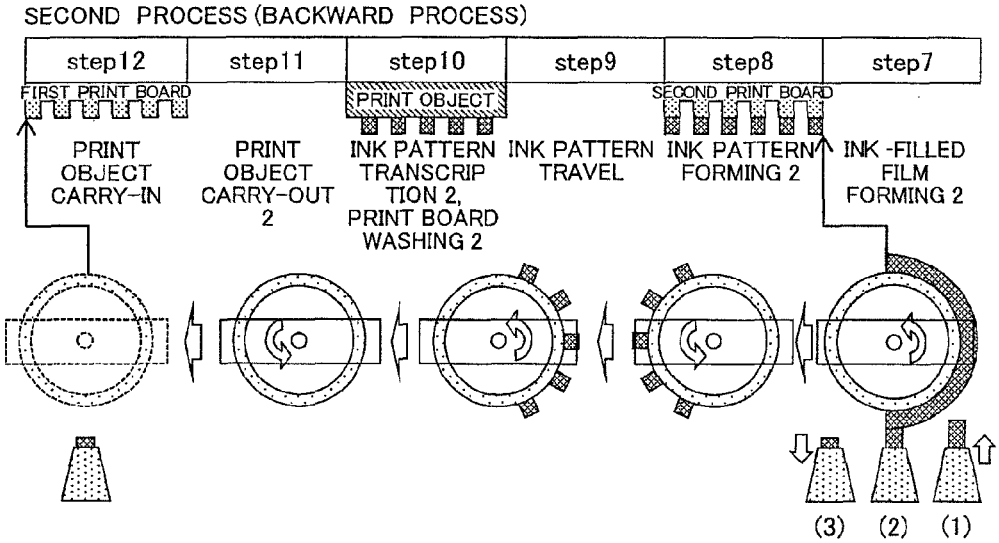

Here, although two coaters and two washers are placed in the present embodiment, one coater and one washer may be placed. Further, the same is applied to the washer too and not only the washer may comprise one washing device and one dryer but also an identical printing plate may be washed twice. FIGS. 12A and 12B are process charts schematically showing pattern forming processes using a printing apparatus and a reverse printing method according to the present embodiment. FIG. 12A represents a forward pattern forming process (the print roll and the washer move rightward in the figure) and FIG. 12B represents a backward pattern forming process (the print roll and the washer move leftward in the figure). As shown in the figures, each of the forward and backward pattern forming processes comprises the six processes below.

1) To form an ink-filled film at the part of a half of the circumferential length on the surface of the print roll. Here, the print roll, the first coater, and the first printing plate are placed so that the center of the print roll, the center of the slit of the first coater, and the front end of the first printing plate may align with each other.

2) To form an ink pattern on the surface of the print roll by: moving the print roll toward the print object while bringing the first printing plate into contact with the ink-filled film formed at the part of the half of the circumferential length on the surface of the print roll; and removing the ink of unnecessary parts from the ink-filled film.

3) To move the print roll to a position where the center of the print roll aligns with the front end of the print object while rotating the print roll only a distance corresponding to a half of the circumferential length and prepare to transcribe the ink pattern formed on the surface of the print roll to the print object.

4) To move the print roll while bringing the ink pattern formed on the surface of the print roll into contact with the print object such as a glass substrate and transcribe the ink pattern formed on the surface of the print roll to the print object. At the same time, to wash the ink remaining on the first printing plate and dry the first printing plate while moving the first washer toward the print object.

5) To carry out the print object on which the ink pattern is transcribed and formed.

6) To carry in and set a next print object and prepare for the backward pattern forming. At the same time, to move the print roll to a predetermined position above the second coater and move the first washer to a predetermined standby position on the side of the first coater.

The following aspects are considered as the control of the devices such as the print roll, the coater, and the washer in the six processes. The rotation of the print roll and the vertical movement of the slit of the coater in the process 1). The rotation speed and the travel speed of the print roll in the processes 2) and 3). The rotation speed and the travel speed of the print roll, the travel speed of the washer, and the like in the process 4). By controlling the devices with a high degree of accuracy, it is possible not only to operate a printing apparatus continuously but also to form a pattern having the same quality as a photolithography process.

Embodiment 6

Figure 8C:
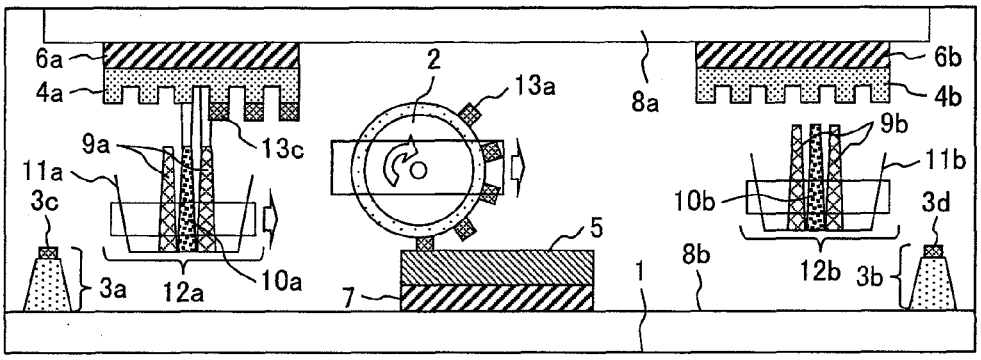
FIG. 8C is a sectional view schematically showing printing apparatuses according to embodiment 6 of the present invention.

FIG. 8C is a sectional view schematically showing a printing apparatus using a reverse printing method according to the present embodiment. The printing apparatus in FIG. 8C comprises a frame 1, a print roll 2, coaters 3, printing plates 4*a* and 4*b*, a print object 5, stages 6*a* and 6*b*, a stage 7, washing devices 9*a* and 9*b*, dryers 10*a* and 10*b*, cleaning agent recovery devices 11*a* and 11*b*, and washers 12*a* and 12*b*. Here, the frame 1 is not essential for the printing apparatus.

In FIG. 8C, the fixed base 8*a* is placed at the upper part of the frame 1. The fixed base 8*b* is placed at the lower part of the frame 1. In other words, the fixed base 8*b* is placed below the print roll 2. The stages 6*a* and 6*b* are tightly placed on the bottom face of the upper fixed base 8*a*. The printing plates 4*a* and 4*b* are placed on the bottom faces of the stages 6*a* and 6*b* in a sticking manner. That is, the upper fixed base section comprises the fixed base 8*a*, the stages 6*a* and 6*b*, and the printing plates 4*a* and 4*b*.

The stage 7 is tightly placed on the top face of the lower fixed base 8*b*. The print object 5 is placed on the top face of the stage 7 in a sticking manner. That is, the lower fixed base section comprises the lower fixed base 8*b*, the stage 7, and the print object 5.

The print roll 2 and the washers 12*a* and 12*b* having movable function of traveling using the top face or the bottom face of the frame 1 as a guide are placed. The washer 12*a* comprises the two washing devices 9*a*, the dryer 10*a*, and the cleaning agent recovery device 11*a*. The washer 12*b* comprises the two washing devices 9*b*, the dryer 10*b*, and the cleaning agent recovery device 11*b*. The coaters 3*a* and 3*b* are tightly placed so that the front ends of the printing plates 4*a* and 4*b* may align with the centers of the slits 3*c* and 3*d* respectively below the frame 1. The printing apparatus in FIG. 8B is a type of moving the print roll 2 and the washers 12*a* and 12*b*.

Here, although the two washers are placed in FIG. 8C, the present invention is not limited to this case and only one washer may be placed.

Meanwhile, although the coaters 3*a* and 3*b* are placed so that the front ends of the printing plates 4*a* and 4*b* may align with the centers of the slits 3*c* and 3*d* respectively in FIG. 8C, the present invention is not limited to this case. Only one coater may be placed on the outside of the printing plate 4*a* or 4*b*. Otherwise, the coaters 3*a* and 3*b* may be placed so that the front ends of the printing plates 4*a* and 4*b* may not align with the centers of the slits 3*c* and 3*d* respectively.

As shown in FIG. 8C, the printing plates 4*a* and 4*b* are placed above the print roll 2 and the print faces of the printing plates 4*a* and 4*b* are directed downward. Further, the washers 12*a* and 12*b* for washing and drying the printing plates 4*a* and 4*b* are placed below the printing plates 4*a* and 4*b* and thereby it is possible to adopt a jet washing method known as a simple liquid washing method and wash the printing plates with a high degree of cleanliness for a short period of time. Moreover, it is possible to cope with the formation of a minute pattern 10 microns or less in pattern width and form a pattern of a high fineness, a high reproducibility, and a high operation rate.

Further, in each of the forward and backward pattern forming, since a pattern is formed by using a half of the circumferential length of the print roll, it is possible to prolong the lifespan of a blanket being mounted on the surface of the print roll and having silicone rubber on the outermost surface. Furthermore, since the area where the print roll touches the printing plate increases by increasing the diameter of the print roll and thereby the deformation of the blanket caused by compression stress reduces, it is possible to reduce the depth of the recesses of the printing plate.

FIGS. 13A to 13H are sectional views schematically showing the processes of a pattern forming method shown in FIG. 8C. The pattern forming processes shown in FIGS. 13A to 13D represent the forward movement and the pattern forming processes shown in FIGS. 13E to 13H represent the backward movement.

Figure 13A:
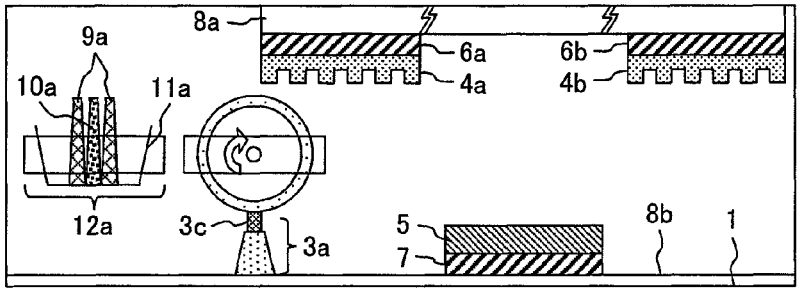
FIG. 13A to 13H are sectional views schematically showing a printing apparatus according to the embodiment 6 of the present invention.

Firstly, the forward process of forming a pattern by using the print roll 2, the printing plate 4*a*, and the washer 12*a* is explained. The process of forming an ink-filled film 13 on the surface of the print roll 2 shown in FIG. 13A is as follows. The slit 3*c* of the coater 3*a* placed below the print roll 2 on which the silicone rubber blanket is mounted moves upward and touches the print roll 2. Thereafter, the slit 3*c* moves downward so that the space between the surface of the print roll 2 and the slit 3*c* may be a predetermined value, the print roll 2 rotates at a rotation frequency that allows a film of a predetermined thickness to be formed in a fixed state, and thereby an ink-filled film 13 of a desired thickness is formed.

Here, in the process of forming the ink-filled film 13 on the surface of the print roll 2, the printing plate 4*a* placed on the fixed base 8*a*, the print roll 2, and the coater 3*a* placed on the fixed base 8*b* are placed so that the front end of the printing plate 4*a*, the center of the print roll 2, and the center of the slit 3*c* may nearly align with each other.

Further, the length of the printing plate 4*a*, the length of the printing plate 4*b*, the length of the print object 5, the distance between the rear end of the printing plate 4*a* and the front end of the print object 5, and the distance between the front end of the printing plate 4*b* and the rear end of the print object 5 are equal to a half of the circumferential length of the print roll 2.

Figure 13B:
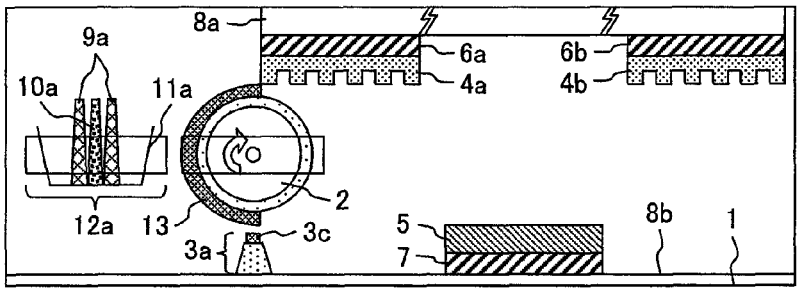

Successively, the process of forming an ink pattern 13*a* on the surface of the print roll 2 shown in FIG. 13B is as follows. The head of the ink-filled film 13 formed on the surface of the print roll 2 reaches the front end of the printing plate 4*a* and touches the printing plate 4*a*. At the same time, the print roll 2 starts to move toward the print object 5, the ink at the part touching the protrusions of the printing plate 4*a* is removed from the ink-filled film 13 formed on the surface of the print roll 2, and an ink pattern 13*a* is formed on the surface of the print roll 2.

With regard to the print roll 2 here, simultaneously with the end of the formation of the ink pattern 13*a*, the print roll 2 stops to rotate and immediately moves in the state of being able to transcribe the ink pattern 13*a* to the print object 5.

Simultaneously with the end of the formation of the ink pattern 13*a*, the washer 12*a* comprising the two washing devices 9*a*, the dryer 10*a*, and the cleaning agent recovery device 11*a* starts to move toward the printing plate 4*a* in order to wash the ink remaining on the printing plate 4*a*.

Here, the ink pattern 13*a* formed on the surface of the print roll 2 corresponds to the concave pattern part formed on the printing plate 4*a*. It is important to set the depth of the recesses of the printing plate 4*a* so that the ink-filled film 13 may not touch the bottom face of the concave pattern formed on the printing plate 4*a* when the printing plate 4*a* touches the ink-filled film 13 formed on the surface of the print roll 2.

Figure 13C:
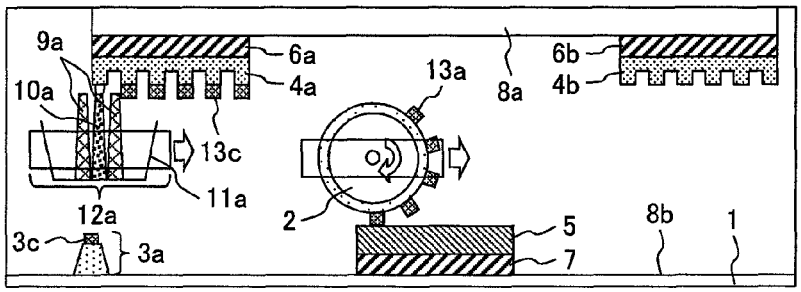

Successively, the process of: transcribing the ink pattern 13*a* formed on the surface of the print roll 2 to the print object 5; and removing and washing the ink remaining on the printing plate 4*a* shown in FIG. 13C is as follows. The ink pattern 13*a* formed on the surface of the print roll 2 touches the print object 5 and is transcribed. At the same time, the washer 12*a* that has moved to the front end of the printing plate 4*a* starts washing. The transcription of the ink pattern 13*a* is completed when the whole ink pattern 13*a* formed on the surface of the print roll 2 is transcribed to the print object 5. At the same time, the removal and washing of the ink remaining on the printing plate 4*a* with the washer 12*a* are also completed.

Figure 13D:
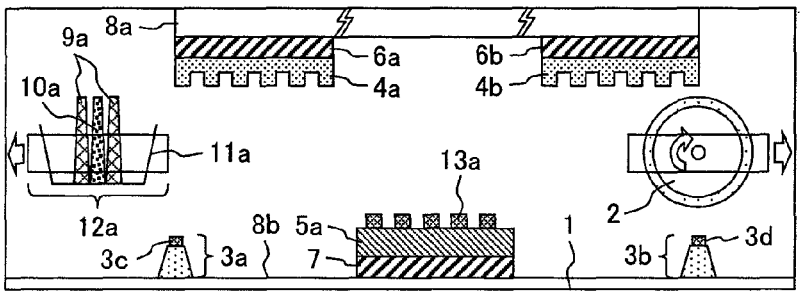

Successively, the process of carrying out the print object 5*a* to which the ink pattern 13*a* is transcribed and carrying in a next print object 5 shown in FIG. 13D is as follows. The print roll 2 moves to the position where the center of the print roll 2 aligns with the rear end of the printing plate 4*b* on the extension of the center line of the slit 3*d* of the coater 3*b* and stops. At the same time, the washer 12*a* moves to a predetermined standby position on the side of the coater 3*a* and stops. The print object 5*a* to which the ink pattern 13*a* is transcribed is carried out, a next print object is carried in and set, and the forward pattern forming process finishes.

Secondly, the backward process of forming a pattern while moving the print roll 2 toward the left in the figure is explained. The explanations are given briefly since the movement of each device is basically the same as that in the forward process.

Figure 13E:
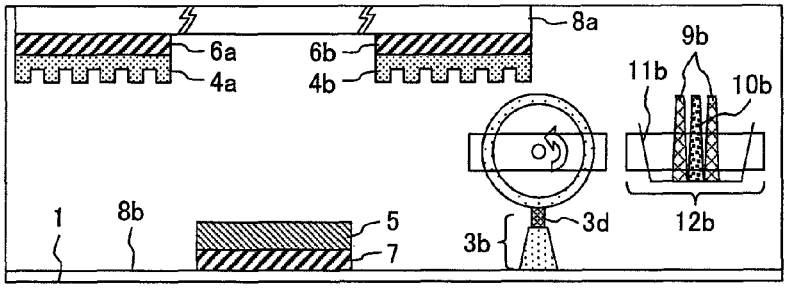

Firstly, the process of forming an ink-filled film on the surface of the print roll 2 shown in FIG. 13E is as follows. The slit 3*d* of the coater 3*b* placed below the print roll 2 on which the silicone rubber blanket is mounted moves upward and touches the print roll 2. Thereafter, the slit 3*d* moves downward so that the space between the surface of the print roll 2 and the slit 3*d* may be a predetermined value, the print roll 2 rotates at a rotation frequency that allows a film of a predetermined thickness to be formed in a fixed state, and thereby an ink-filled film of a desired thickness is formed.

Here, in the process of forming the ink-filled film on the surface of the print roll 2, the printing plate 4*b* placed on the fixed base 8*a*, the print roll 2, and the coater 3*b* placed on the fixed base 8*b* are placed so that the front end of the printing plate 4*b*, the center of the print roll 2, and the center of the slit 3*d* of the coater 3*b* may align with each other.

Figure 13F:
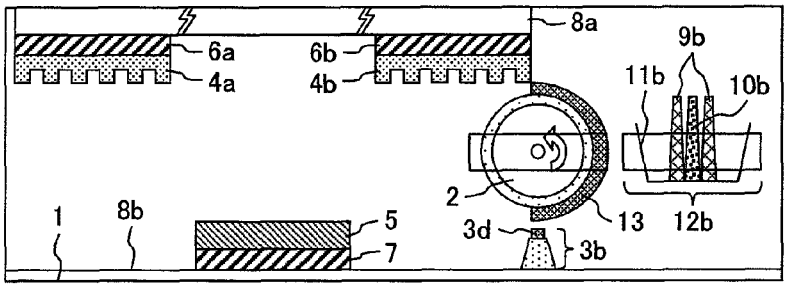

Successively, the process of forming an ink pattern on the surface of the print roll 2 shown in FIG. 13F is as follows. The front end of the ink-filled film 13 formed on the surface of the print roll 2 reaches the front end of the printing plate 4*b* and touches the printing plate 4*b*. At the same time, the print roll 2 starts to move toward the print object 5, the ink at the part touching the protrusions of the printing plate 4*b* is removed from the ink-filled film 13 formed on the surface of the print roll 2, and an ink pattern is formed on the surface of the print roll 2.

With regard to the print roll 2 here, simultaneously with the end of the formation of the ink pattern, the print roll 2 stops to rotate and immediately moves in the state of being able to transcribe the ink pattern to the print object 5.

Simultaneously with the end of the formation of the ink pattern, the washer 12*b* comprising the two washing devices 9*b*, the dryer 10*b*, and the cleaning agent recovery device 11*b* starts to move toward the printing plate 4*b* in order to wash the ink remaining on the printing plate 4*b*.

Here, the ink pattern formed on the surface of the print roll 2 corresponds to the concave pattern part formed on the printing plate 4*b*. It is important to set the depth of the recesses of the printing plate 4*b* so that the ink-filled film 13 may not touch the bottom face of the concave pattern formed on the printing plate 4*b* when the printing plate 4*b* touches the ink-filled film 13 formed on the surface of the print roll 2.

Figure 13G:
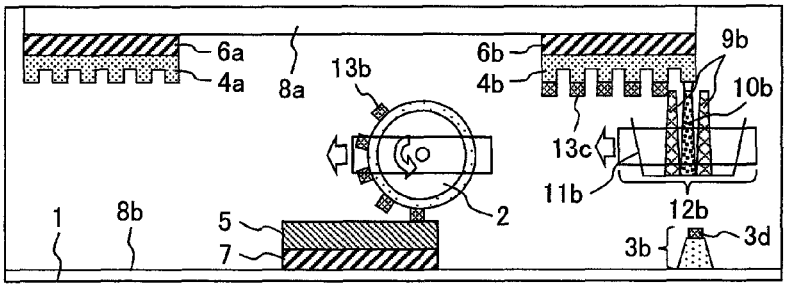

Successively, the process of: transcribing the ink pattern 13*b* formed on the surface of the print roll 2 to the print object 5; and removing and washing the ink remaining on the printing plate 4*b* shown in FIG. 13G is as follows. The ink pattern 13*b* formed on the surface of the print roll 2 touches the print object 5 and is transcribed. At the same time, the washer 12*b* that has moved to the front end of the printing plate 4*b* starts washing. Thereafter, the whole ink pattern 13*a* formed on the surface of the print roll 2 is transcribed to the print object 5 and the transcription of the ink pattern 13*b* is completed. At the same time, the removal and washing of the ink remaining on the printing plate 4*b* with the washer 12*b* are also completed.

Figure 13H:
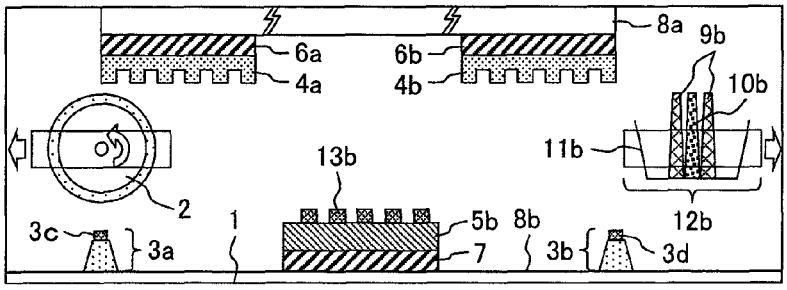

Successively, the process of carrying out the print object 5*b* to which the ink pattern 13*b* is transcribed and carrying in a next print object 5 shown in FIG. 13H is as follows. The print roll 2 moves to a position where the center of the print roll 2 aligns with the front end of the printing plate 4*a* on the extension of the center line of the slit 3*c* of the coater 3*a* and stops. At the same time, the washer 12*b* moves to a predetermined standby position on the side of the coater 3*b* and stops. The print object 5*b* to which the ink pattern 13*a* is transcribed is carried out, a next print object is carried in and set, and the backward pattern forming process finishes.

By repeating the above processes, it is possible to form a pattern of a high print reproducibility and a high operation rate at a low cost. Further, even in the case of using a printing plate 10 microns or less in pattern width that has been regarded as hardly washable with a liquid, it is possible to wash the printing plate with a high degree of cleanliness and form a stable pattern of a high print reproducibility.

Further, a feature of the present embodiment is that, since a pattern is formed by using a half periphery of the silicone rubber blanket mounted on the surface of the print roll in each of the forward and backward pattern forming, the lifespan of the silicone rubber blanket is long.

Furthermore, another feature of the present embodiment is that, by placing the print object 5 and the stage 7 for the print object below the print roll 2, it is possible to simplify the devices related to the disposition, carry-in, and carry-out of the print object 5.

Figure 14A:
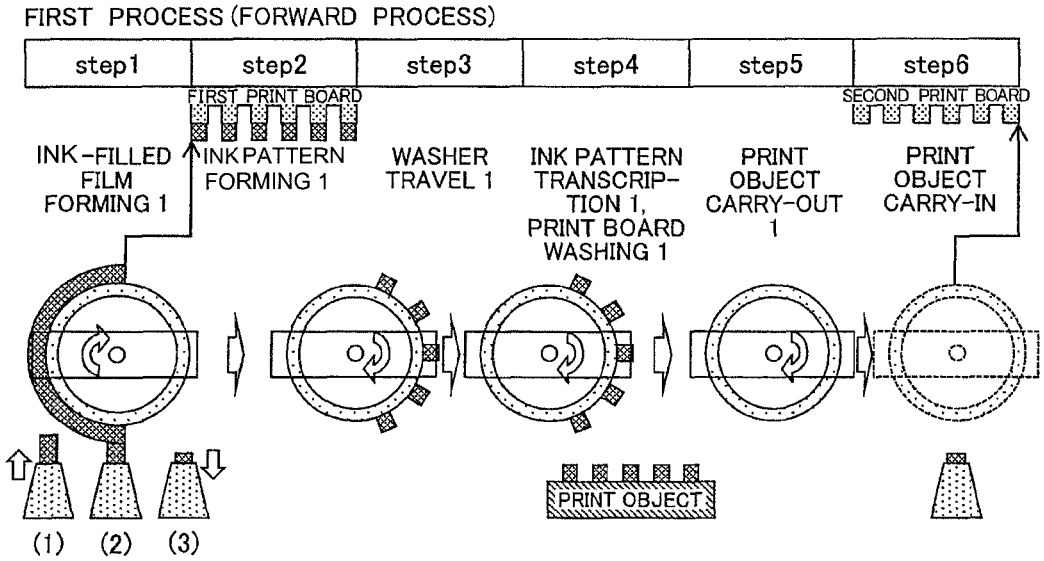
FIGS. 14A and 14B are sectional views schematically showing the processes of a printing method using a printing apparatus according to the embodiment 6 of the present invention.
Figure 14B:
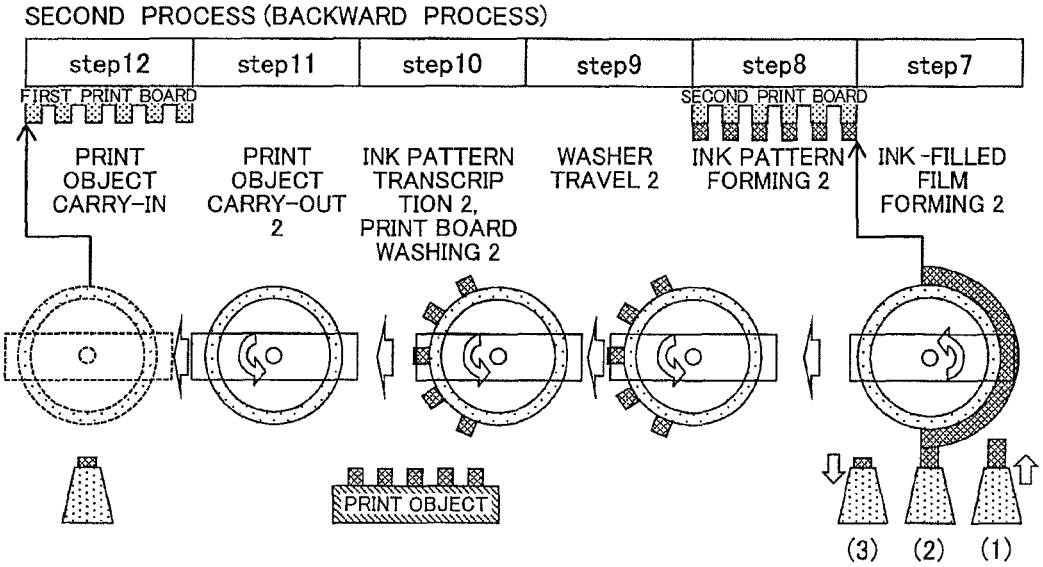

Here, although the two coaters and two washers are placed in the present embodiment, the present invention is not limited to this case and one coater and one washer may be placed. Further, the same is applied to the washer too and not only the washer may comprise one washing device and one dryer but also an identical printing plate may be washed twice. FIGS. 14A and 14B are process charts schematically showing pattern forming processes using a printing apparatus and a reverse printing method according to the present embodiment. FIG. 14A represents a forward pattern forming process (the print roll and the washer move rightward in the figure) and FIG. 14B represents a backward pattern forming process (the print roll and the washer move leftward in the figure). As shown in the figures, each of the forward and backward pattern forming processes comprises the six processes below.

1) To form an ink-filled film at the part of a half of the circumferential length on the surface of the print roll. Here, the print roll, the first coater, and the first printing plate are placed so that the center of the print roll, the center of the slit of the first coater, and the front end of the first printing plate may align with each other.

2) To form an ink pattern on the surface of the print roll by: moving the print roll toward the print object while bringing the first printing plate into contact with the ink-filled film formed at the part of the half of the circumferential length on the surface of the print roll; and removing the ink of unnecessary parts from the ink-filled film.

3) To move the print roll to a position where the center of the print roll aligns with the front end of the print object in the state of stopping the rotation of the print roll and prepare to transcribe the ink pattern formed on the surface of the print roll to the print object.

4) To rotationally move the print roll while bringing the ink pattern formed on the surface of the print roll into contact with the print object such as a glass substrate and transcribe the ink pattern formed on the surface of the print roll to the print object. At the same time, to remove and wash the ink remaining on the first printing plate while moving the first washer toward the print object.

5) To carry out the print object on which the ink pattern is transcribed and formed.

6) To carry in and set a next print object and prepare for the backward pattern forming. At the same time, to move the print roll to a predetermined position above the second coater and move the first washer to a predetermined standby position on the side of the first coater.

The following aspects are considered as the control of the devices such as the print roll, the coater, and the washer in the six processes. The rotation of the print roll and the vertical movement of the slit of the coater in the process 1). The rotation speed and the travel speed of the print roll in the processes 2) and 3). The rotation speed and the travel speed of the print roll, the travel speed of the washer, and the like in the process 4). By controlling the devices with a high degree of accuracy, it is possible not only to operate a printing apparatus continuously but also to form a pattern having the same quality as a photolithography process.

What is claimed is:

1. A printing apparatus, comprising:

a print roll;

a coater placed below the print roll for forming ink on the print roll;

a first base placed above the print roll;

a first stage placed on the bottom face of the first base;

a first printing plate placed on the bottom face of the first stage;

a print object having a first face to which the ink formed on the print roll is transcribed;

a second stage placed on a second face of the print object opposite the first face of the print object; and a washer for washing the first printing plate, wherein the washer has a washing device; and a spray nozzle of the washing device is directed to the side where the first base exists.

2. A printing apparatus according to claim 1, wherein:

the second face of the print object on which the second stage is placed is the top face of the print object;

the first base is movable; and the washer is fixed.

3. A printing apparatus according to claim 1, wherein:

the second face of the print object on which the second stage is placed is the top face of the print object;

the first base is fixed; and the washer is movable.

4. A printing apparatus according to claim 1, wherein:

the printing apparatus has a second base placed below the print roll;

the second face of the print object on which the second stage is placed is the bottom face of the print object;

the first base and second base are fixed; and the washer is movable.

5. A printing apparatus according to claim 1, wherein:

a third stage is placed on the bottom face of the first base; and a second printing plate is placed on the bottom face of the third stage.

6. A printing apparatus according to claim 1, wherein the washer includes a dryer.

7. A printing apparatus according to claim 1, wherein the washer includes a cleaning agent recovery device.

8. A printing apparatus according to claim 1, wherein the washer includes two or more washing devices.

9. A printing apparatus according to claim 2, wherein:

a third stage is placed on the bottom face of the first base; and a second printing plate is placed on the bottom face of the third stage.

10. A printing apparatus according to claim 3, wherein:

a third stage is placed on the bottom face of the first base; and a second printing plate is placed on the bottom face of the third stage.

11. A printing apparatus according to claim 2, wherein the washer includes a dryer.

12. A printing apparatus according to claim 3, wherein the washer includes a dryer.

13. A printing apparatus according to claim 4, wherein the washer includes a dryer.

14. A printing apparatus according to claim 2, wherein the washer includes a cleaning agent recovery device.

15. A printing apparatus according to claim 3, wherein the washer includes a cleaning agent recovery device.

16. A printing apparatus according to claim 4, wherein the washer includes a cleaning agent recovery device.

17. A printing apparatus according to claim 2, wherein the washer includes two or more washing devices.

18. A printing apparatus according to claim 3, wherein the washer includes two or more washing devices.

19. A printing apparatus according to claim 4, wherein the washer includes two or more washing devices.

* * * * *